US007331804B2

(12) United States Patent
Okada et al.

(10) Patent No.: US 7,331,804 B2
(45) Date of Patent: Feb. 19, 2008

(54) POWER-SOURCE OUTLET

(75) Inventors: Hiroki Okada, Seto (JP); Masahiro Nishioka, Kariya (JP)

(73) Assignee: Togo Seisakusyo Corporation, Aichi (JP)

( * ) Notice: Subject to any disclaimer, the term of this patent is extended or adjusted under 35 U.S.C. 154(b) by 0 days.

(21) Appl. No.: 11/354,121

(22) Filed: Feb. 15, 2006

(65) Prior Publication Data

US 2007/0190813 A1 Aug. 16, 2007

(51) Int. Cl.
*H01R 13/44* (2006.01)

(52) U.S. Cl. ..... 439/139

(58) Field of Classification Search ..... 439/139, 439/143, 145, 142, 136
See application file for complete search history.

(56) References Cited

U.S. PATENT DOCUMENTS 5,842,878 A * 12/1998 Huag ..... 439/139
5,866,846 A * 2/1999 Huag ..... 174/67
5,997,319 A * 12/1999 Wu ..... 439/143

* cited by examiner

*Primary Examiner*—Javaid H. Nasri
(74) *Attorney, Agent, or Firm*—Wenderoth, Lind & Ponack, L.L.P.

(57) ABSTRACT

Wobbling of a coil portion of a torsion spring for urging a rotor/cover to a "usage position" is prevented. An outlet cover of an outlet main body has plugholes for insertion of the plug-in terminals of an outlet plug. A rotor/cover is pivotally provided so that its position can be switched between a "non-usage position," where the plugholes are closed off, and a "usage position," where a plug can be connected to the outlet. A supporting axle portion is provided between the outlet cover and the rotor/cover that can support the coil portion of a torsion spring for urging the rotor/cover to the "nonusage position". The torsional arms of the torsion spring are respectively engaged with the outlet main body and the rotor/cover by utilizing the relative pivoting of the rotor/cover with respect to the outlet main body.

17 Claims, 18 Drawing Sheets

POWER-SOURCE OUTLET

BACKGROUND OF THE INVENTION

1. Field of the Invention

The present invention relates to a power-source outlet (also referred to as a consent) that is provided in a vehicle for the purpose of operating, for example, an electric household appliance in the vehicle.

2. Description of the Prior Art

Conventional power-source outlets are known. This kind of outlet includes, for example, a consent described in Japanese Patent No. 3299309. In the consent described in Japanese Patent No. 3299309 and as illustrated in FIG. 17, a rotor/cover 106, which closes off the plug holes 146 of an outlet main body 102, is pivotally provided on the outlet main body 102. Insertion holes 166 are formed in the rotor/cover 106 whose locations coincide with the locations of the corresponding plugholes 146 at a "usage position". A torsion spring 107 is disposed in a hole 102*a* provided in the outlet main body 102. Torsional arms 107*b* protrude radially outward from the torsion spring 107. The torsional arms 107*b* are respectively fitted to a groove portion 102*b* (refer to FIG. 18) of the outlet main body 102 and a groove portion (not illustrated) formed in the rotor/cover 106. At an initial position of the rotor/cover 106, where the torsion spring 107 causes a pivoting urge, i.e., at a "non-usage position", the rotor/cover 106 closes off the plugholes 146 of the outlet main body 102. A drive pin, a pivotal axle 164, is driven into and fixed to the rotor/cover 106 from the interior of the outlet main body 102 (the lower side as viewed in FIG. 17).

SUMMARY OF THE INVENTION

According to Japanese Patent No. 3299309 described above, the torsion spring 107 is disposed in the hole 102*a* of the outlet main body 102 (refer to FIG. 18). In general, the torsion spring 107 is elastically deformed in such a way as to reduce the coil diameter. Accordingly, when the rotor/cover 106 is pivoted to the usage position by utilizing the elastic deformation of the torsion spring 107, the space 100S is enlarged between the peripheral face of the torsion spring 107 and the inner wall face of the hole 102*a* of the outlet main body 102. This may allow the torsion spring 107 to wobble, and in an extreme case, the stability of the rotor/cover 106 may be impaired. In addition, as illustrated in FIG. 18, the axle diameter of the drive pin 164 is smaller than the inner diameter of the torsion spring 107 by one third to a half of the inner diameter. Therefore, no provision is made for a mechanism that can support the torsion spring 107. In other words, in Japanese Patent No. 3299309, there is no concept for preventing the wobbling of the torsion spring 107.

Moreover, while taking care to implement proper positioning, the mounting of the torsion spring 107 is complicated because the respective torsional arms 107*b* of the torsion spring 107 are fitted to groove portions 102*b* formed in the outlet main body 102 and the rotor/cover 106.

The issue to be solved by the present invention is to prevent the wobbling of the coil portion of a torsion spring used for urging a rotor/cover to a non-usage position, and to provide an outlet that enables the torsion spring to be readily mounted.

The foregoing issues can be solved by outlets having the configurations of the present invention.

In other words, an outlet according to one aspect of the current invention includes an outlet main body having plug holes into which the plug-in terminals of a plug for the outlet can be inserted. The outlet also includes a rotor/cover that has insertion holes through which the plug-in terminals can be inserted. The rotor/cover is provided in such a way as to be pivotal with respect to the outlet main body. The position of the rotor/cover can be switched between a non-usage position, where the plugholes are closed off, and a usage position where the openings of the plugholes correspond to the insertion holes. In addition, the outlet includes a torsion spring that is interposed between the outlet main body and the rotor/cover. The torsion spring urges or biases the rotor/cover to a non-usage position.

A supporting axle portion is provided between the outlet main body and the rotor/cover. The supporting axle portion is fitted to the inside of the coil portion of the torsion spring and can support the coil portion of the torsion spring.

Furthermore, a configuration is employed in which the torsional arms of the torsion spring are respectively engaged with the outlet main body and the rotor/cover. This is accomplished by utilizing the relative pivoting of the rotor/cover with respect to the outlet main body.

In the outlet configured as described above, while the rotor/cover, pivotally provided on the outlet main body, is urged by the torsion spring to a non-usage position, the plugholes of the outlet main body are closed off by the rotor/cover. Accordingly, the entry of foreign materials into the plugholes of the outlet main body can be prevented or reduced.

Moreover, when the outlet is in use, the plug for the outlet can be connected to the outlet by utilizing the elastic deformation of the torsion spring to pivot the rotor/cover to the usage position. The plug-in terminals of a plug for the outlet are then inserted through the insertion holes of the rotor/cover and into the plugholes of the outlet main body.

A supporting axle portion is provided between the outlet main body and the rotor/cover so as to prevent or reduce the wobbling of the coil portion of the torsion spring. In particular, the space S between the inner surface of the torsion spring and the outer surface of the supporting axle portion decreases when the torsion spring is elastically deformed in such a way as to reduce the coil diameter. This may be due to the pivoting of the rotor/cover to the usage position. Therefore, the wobbling of the coil portion of the torsion spring can be effectively suppressed. The foregoing fact is advantageous for the enhancement of the stability of the rotor/cover.

The torsional arms of the torsion spring may be respectively engaged with the outlet main body and the rotor/cover by utilizing the relative pivoting of the rotor/cover with respect to the outlet main body. Therefore, the torsion spring can readily be mounted or assembled.

Furthermore, in the outlet of the first aspect of the current invention, according to a second aspect of the current invention, engagement protrusions are provided in the outlet main body and the rotor/cover. The engagement protrusions can be relatively abutted in circumferential directions by the respective torsional arms of the torsion spring by utilizing the relative pivoting of the rotor/cover with respect to the outlet main body.

In the outlet configured as described above, the torsional arms of the torsion spring abut the respective engagement portions provided in the outlet main body and the rotor/cover in the circumferential directions by utilizing the relative pivoting of the rotor/cover with respect to the outlet main body. Accordingly, the mounting positions of the torsional arms of the torsion spring for the outlet main body and the rotor/cover are not limited to tightly fixed positions.

The range can be enlarged in which the torsional arms are allowed mounting. As a result, the torsional arms of the torsion spring can be readily mounted.

Moreover, in the outlet of the second aspect of the current invention, according to a third aspect of the current invention, the engagement portions can position the coil portion of the torsion spring.

In an outlet configured as described above, the engagement portions can also be utilized to position the torsion spring.

Still further, in the outlet of any of the previous three aspects of the current invention, according to a fourth aspect of the current invention, a spring-containing recess is provided for containing the torsion spring in at least one member of the outlet main body or the rotor/cover.

With the configurations described above, the spring-containing recess, provided in at least one member of the outlet main body or the rotor/cover, can contain the torsion spring. Furthermore, because the spring-containing recess is provided in a member having no supporting axle portion, an effect can also be achieved in which the setting of the torsion spring in the member is more readily facilitated.

The outlet of the present invention prevents or reduces the wobbling of the coil portion of a torsion spring, which is used for urging a rotor/cover to a non-usage position. In addition, the outlet of the present invention enables the torsion spring to be readily mounted.

DETAILED DESCRIPTION OF THE PREFERRED EMBODIMENTS

Hereinafter, the most preferred embodiments of the present invention will be explained with reference to the embodiments below.

Embodiment 1

Figure 1:
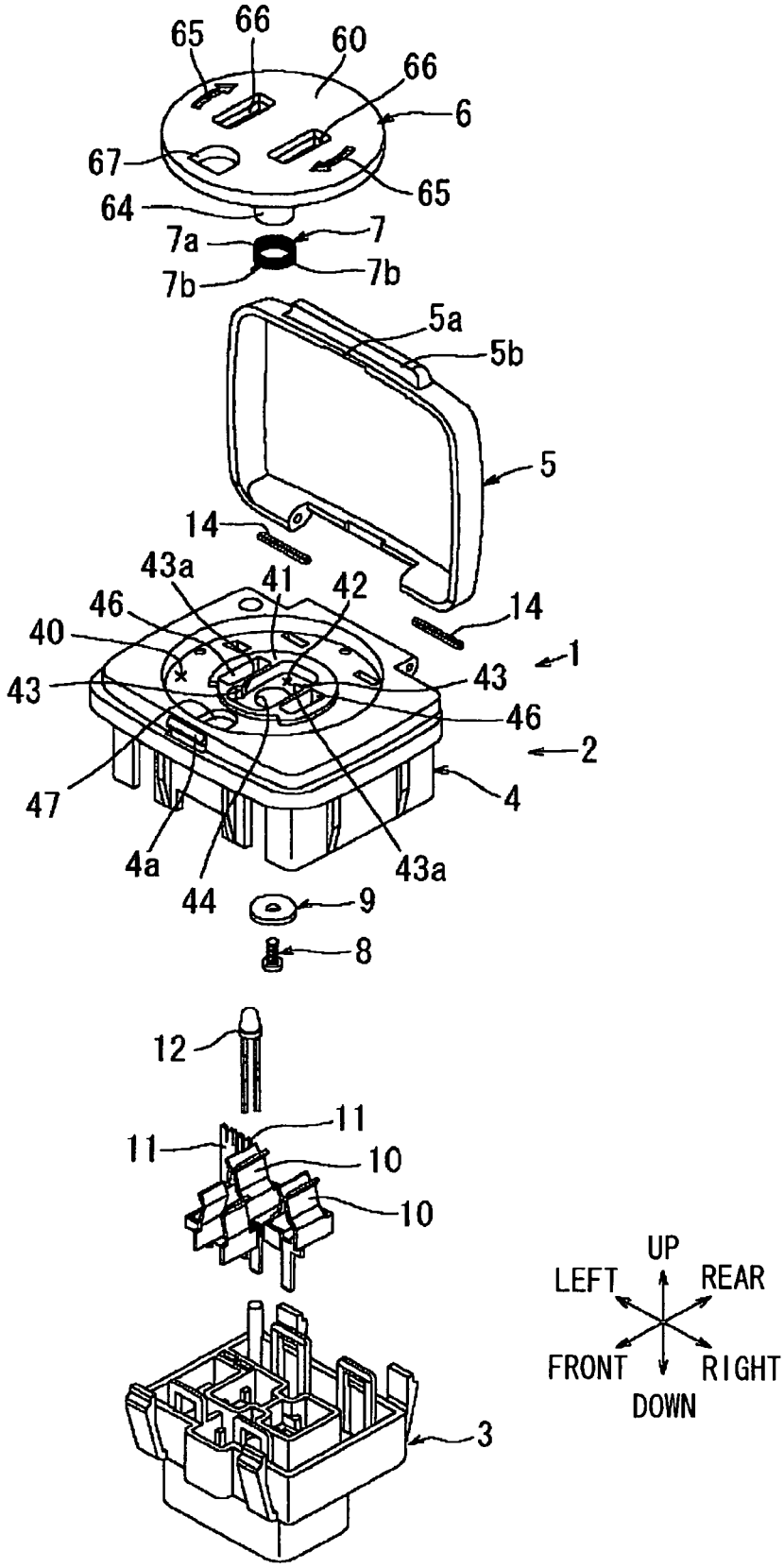
FIG. 1 is an exploded perspective view illustrating an outlet according to Embodiment 1 of the present invention.

Initially Embodiment 1 of the present invention will be detailed. In Embodiment 1, an AC-power-source outlet that is provided in a vehicle will be exemplified. In addition, for the convenience of explanation, the left, right, top, and bottom directions associated with outlet 1 are specified as indicated in FIGS. 1 to 9. As illustrated in FIG. 1, the outlet 1 includes an outlet main body 2, a cover 5, a rotor/cover 6, a torsion spring 7, a screw 8, a washer 9, and the like. Hereinafter, the foregoing elements will be explained in turn.

The outlet main body 2 is configured with an outlet base 3, which forms the bottom portion of the outlet main body 2, and an outlet cover 4, which forms the top portion of the outlet main body 2. The outlet base 3 and the outlet cover 4 are each formed of a molded synthetic resin, for example, and integrated with each other via engagement devices (refer to FIG. 2). In addition, the outlet main body 2 incorporates AC terminals 10, LED terminals 11, an LED 12 as a light emitting device, and the like. For reference's sake, for example, when being provided on an instrument panel of a vehicle, the outlet 1 may be disposed in a state in which the cover 5 faces to the front side of the instrument panel and the outlet main body 2 is contained within the instrument panel. Thus, the direction of the outlet 1 is appropriately changed depending on the location where it is disposed.

In addition, the configuration of the outlet main body 2 is generally the same as that of a known outlet main body (e.g., refer to Japanese Laid-Open Patent Application No. 2003-59579), except for the portion that is to be explained in Embodiment 1. Therefore, a general explanation thereof will be omitted.

Figure 2:
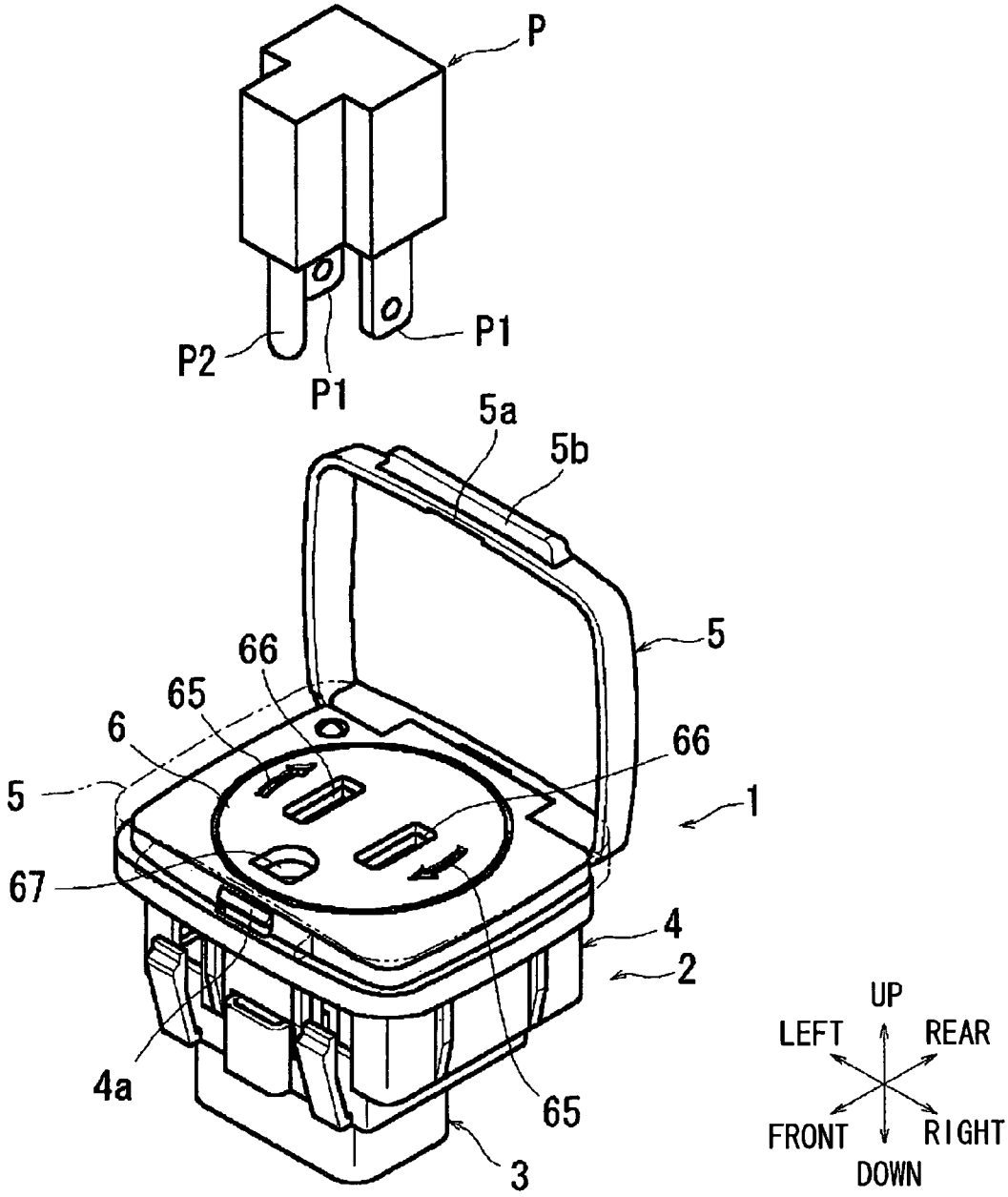
FIG. 2 is a perspective view illustrating an outlet when the cover is opened and the rotor/cover is in a usage position.

As illustrated in FIG. 2, the cover 5 is a member that is formed, for example, of a molded synthetic resin. The cover 5 opens and closes to respectively uncover and cover the top-surface portion of the outlet cover 4. A side portion (the rear-side portion in FIG. 1) of the cover 5 is pivotally coupled to the rear-side portion of the outlet cover 4 via spring pins 14 (refer to FIG. 1). Thus, the cover 5 is provided on the outlet in such a way as to open and close through pivoting. In addition, when the cover 5 is closed (refer to the double-dashed lines 5 in FIG. 2), the cover 5 is fitted to the top-surface portion of the outlet cover 4.

A latch piece 4*a* is provided on the front-side portion of the outlet cover 4 in order to latch the cover 5. Meanwhile, an engagement portion 5*a*, which engages with the latch piece 4*a*, is provided on the front-side portion of the cover 5. The cover 5 is kept closed by utilizing the elastic deformation of the engagement portion 5*a*, with which the engagement portion 5*a* engages with the latch piece 4*a* of the outlet cover 4. Additionally, a configuration is employed in which the engagement between the latch piece 4*a* and the engagement portion 5*a* is released by pushing the cover 5 in the "open" direction and thereby opening the cover 5. A manipulation piece 5*b* is provided on the front-side portion of the cover 5 to aid with the opening of the cover 5.

Figure 6:
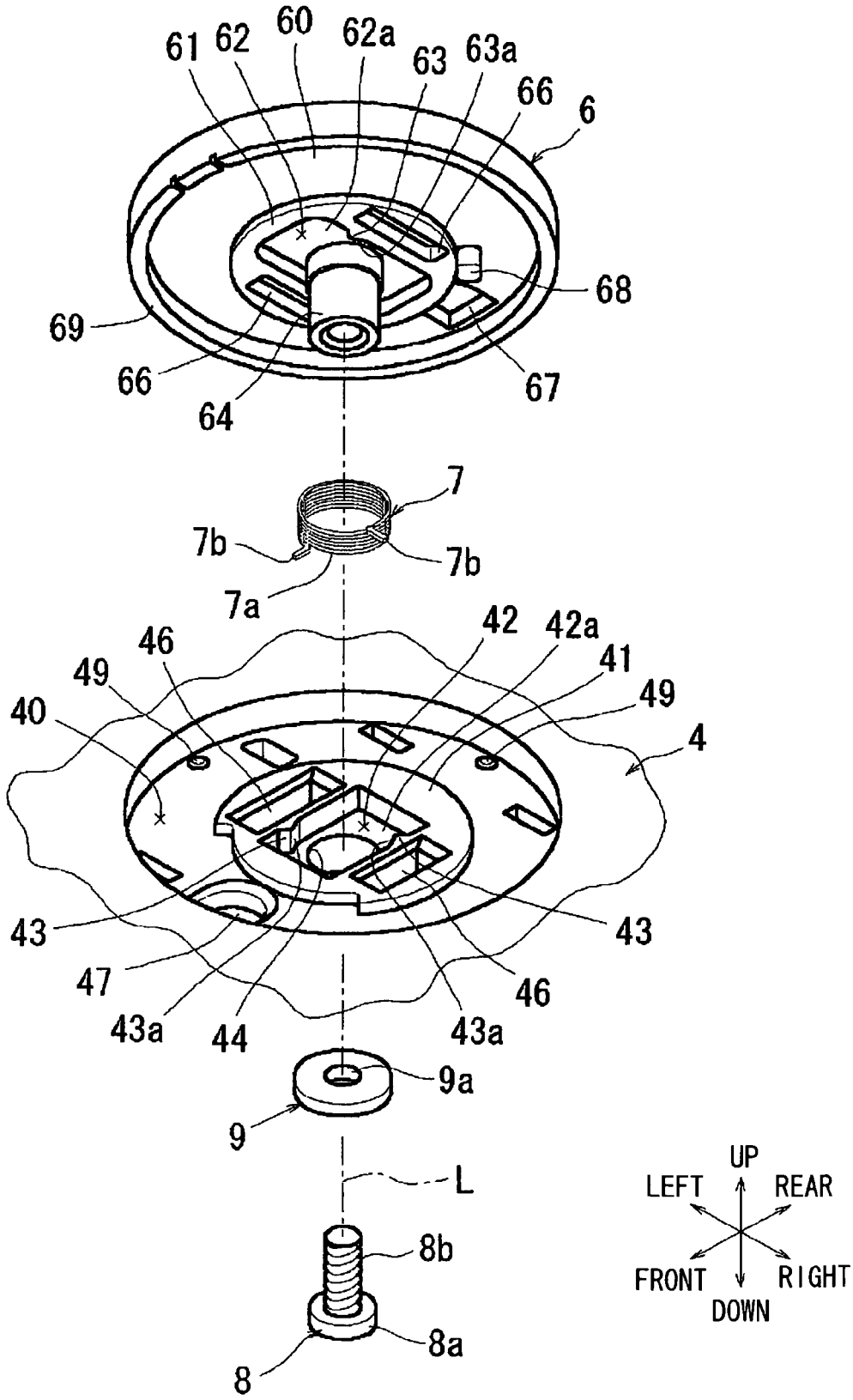
FIG. 6 is an exploded perspective view illustrating a mounting structure in which a rotor/cover is mounted on an outlet main body.

As illustrated in FIG. 1, a circular rotor-containing recess 40 is formed on the top side of the outlet cover 4. A cover-plate portion 60, described later, of the rotor/cover 6 can be fitted to the rotor-containing recess 40. As illustrated in FIG. 6, a circular protrusion portion 41 is formed on the middle portion of a bottom surface of the rotor-containing recess 40. The top surface of the circular protrusion portion 41 is lower than the top surface of the outlet main body 2. In addition, the circular protrusion portion 41 is coaxial with the rotor-containing recess 40 with respect to the line L.

An approximately rectangular spring-containing recess 42 is formed in a middle portion of the protrusion portion 41. The length in the front and rear directions of the spring-containing recess 42 is larger than the length in the left and right directions. The bottom surface of the spring-containing recess 42 is formed as a flat spring-bearing plane 42*a*, which is one step lower than the bottom surface of the rotor-containing recess 40. A circular axle hole 44 is formed in the spring bearing plane 42*a* that is coaxial with the rotor-containing recess 40 with respect to the line L.

Figure 4:
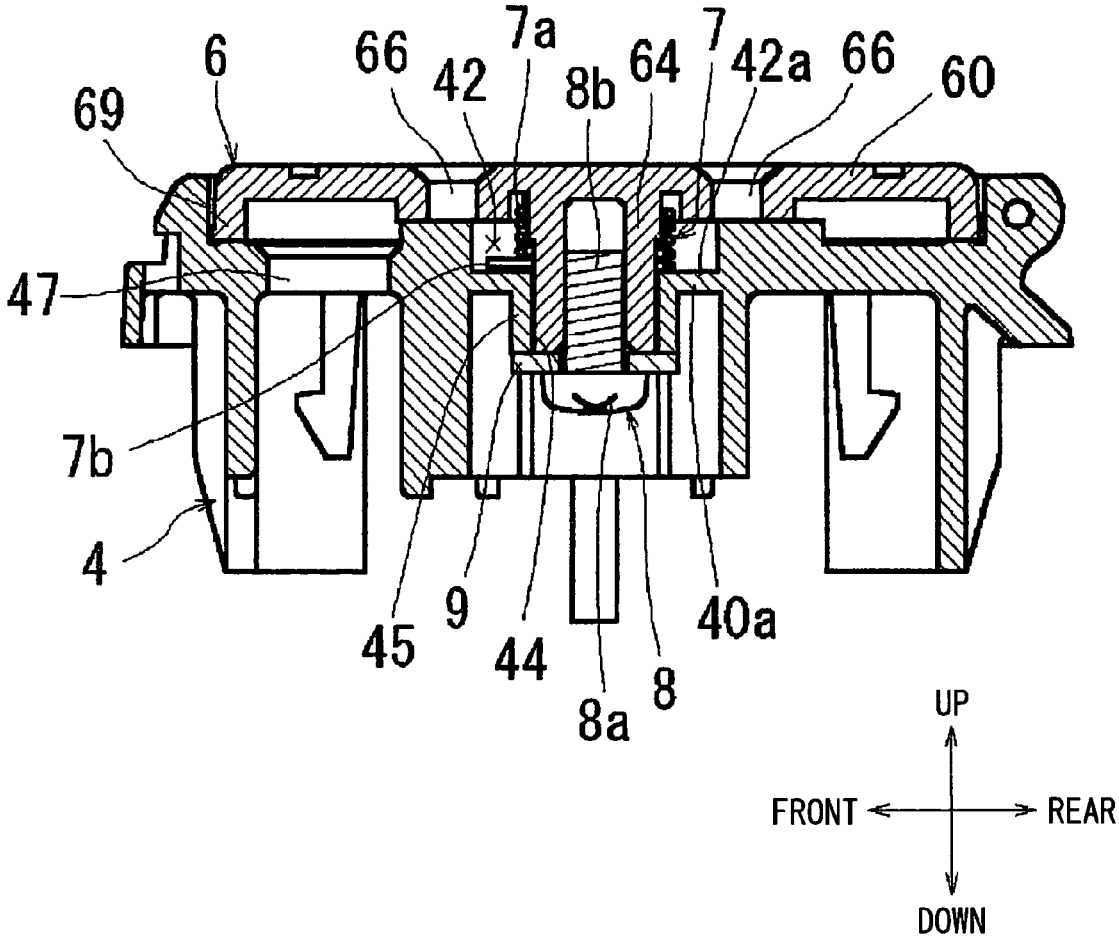
FIG. 4 is a cross-sectional view of the outlet in FIG. 3, taken along the line indicated by the arrows IV-IV.
Figure 7:
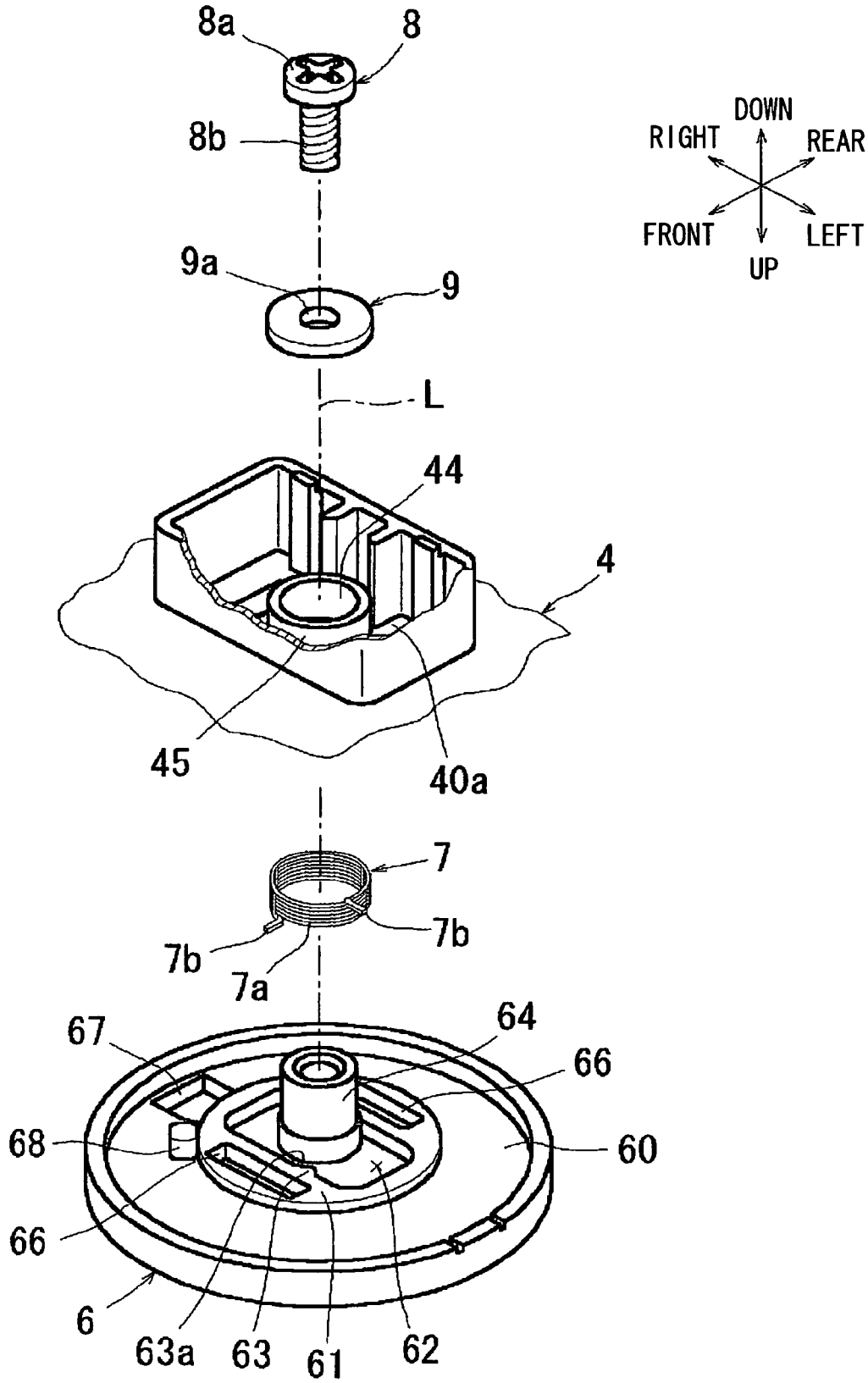
FIG. 7 is an exploded perspective view illustrating a mounting structure in an inverted manner in which a rotor/cover is mounted on an outlet main body.

Referring to FIGS. 4 and 7, the axle hole 44 is extended downward through a tubular portion 45, which is hollow and cylindrical. The tubular portion 45 protrudes from a lower surface of a wall portion 40*a* that forms the spring-bearing plane 42*a* of the outlet cover 4. In addition, the axle hole 44 is formed in such a way as to have a hole diameter that is a predetermined length smaller than the width of the spring-containing recess 42, in a transverse direction, i.e., in the left and right directions (refer to FIG. 8). A configuration is employed in which a supporting axle portion 64, described later, of the rotor/cover 6 is pivotally supported in the axle hole 44 (refer to FIGS. 4 and 5).

Figure 10:
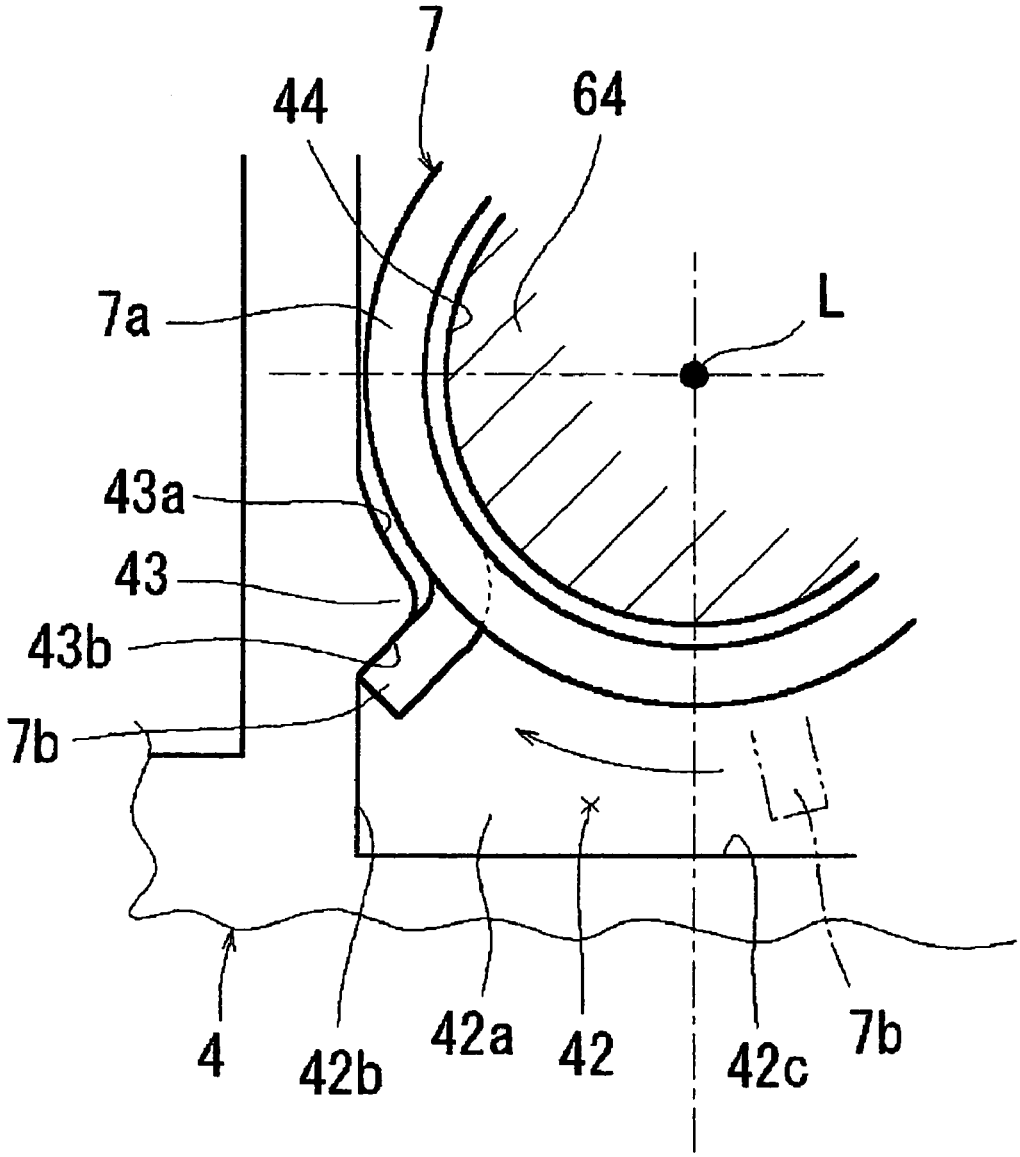
FIG. 10 is an explanatory view for the mounting of a torsion spring in an outlet main body.

As illustrated in FIG. 10, both of the wall faces, facing each other along the transverse direction of the spring-containing recess 42, i.e., both the left and right wall faces 42*b* (refer to FIG. 8) are formed in such a way as to be able to make facial contact with or to be adjacent to the peripheral surface of a coil portion 7*a*, described later, of the torsion spring 7.

Figure 8:
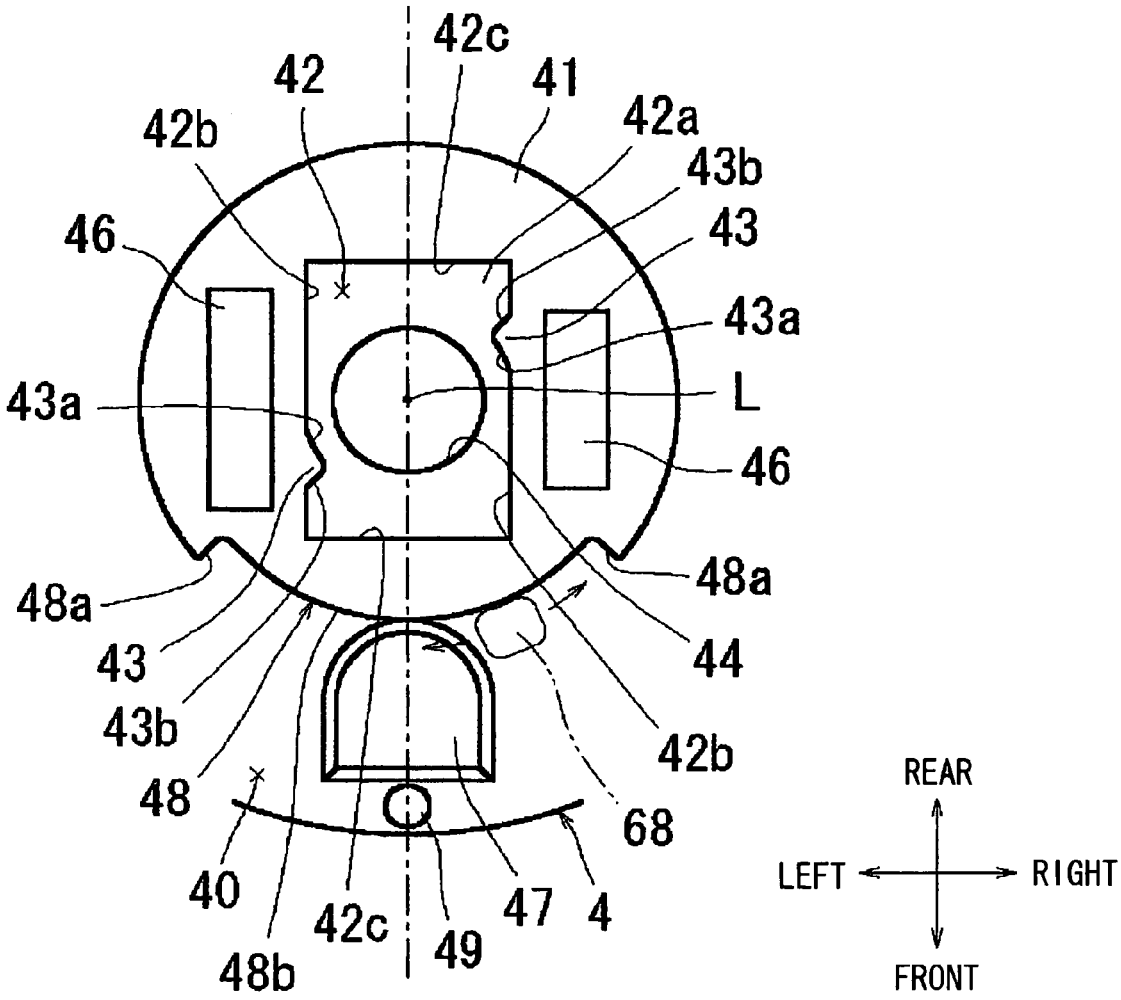
FIG. 8 is a top view illustrating the central parts of an outlet main body.

Moreover, on both the left and right wall faces 42*b* of the spring-containing recess 42, approximately triangular engagement portions 43 are formed in such a way as to be symmetric with respect to the axis line L and left-and-right asymmetric (refer to FIG. 8).

As illustrated in FIG. 10, in the engagement portions 43 the slope on the axle hole 44 side (the top side of the left engagement portion 43 shown in FIG. 10) is formed in such a way as to be able to make facial contact with or to be adjacent to the peripheral surface of the coil portion 7*a*, described later, of the torsion spring 7. In other words, the slope on the axle hole 44 side is formed as a positioning face 43*a* that, along with both of the left and right wall faces 42*b* of the spring-containing recess 42, enables the coil portion 7*a* of the torsion spring 7 to be positioned. In addition, the other slope (the lower side of the left engagement portion 43 shown in FIG. 10) of the engagement portion 43 is formed as an engagement face 43*b* to which one of torsional arms 7*b*, described later, of the torsion spring 7 can relatively abut by utilizing the relative pivoting of the rotor/cover 6 with respect to the outlet main body 2. For reference's sake, the pivoting direction of the rotor/cover 6 with respect to the outlet main body 2 is the same direction as the direction in which the coil diameter of the torsion spring 7 is reduced. Accordingly, in the case of Embodiment 1, if the winding direction for the torsion spring 7 is spiraling clockwise in an upward direction, the direction in which the coil diameter is reduced is clockwise with respect to the plane of the rotor/cover 6. Therefore, by utilizing a clockwise pivoting of the rotor/cover 6, the terminal portion 7*b* of the torsion spring 7 is adapted to abut the engagement face 43*b*. In addition, "clockwise direction" or "anticlockwise direction" termed in the present specification refers to a circumferential direction with regard to the plane of the outlet 1.

As illustrated in FIG. 8, a couple of approximately rectangular, left and right, plugholes 46 (referred to as "first plugholes") are formed in the protrusion portion 41. The lengths of the plugholes 46 in the front and rear directions are larger than the lengths in the left and right directions. In addition, the plugholes 46 are left-and-right symmetric with respect to each other. Moreover, in the bottom surface of the rotor-containing recess 40, an approximately semicircular plughole 47 (referred to as "a second plughole") is formed and is situated in front of the spring-containing recess 42.

Respective first and second plug-in terminals P1 and P2 (refer to FIG. 2) of a three-pronged plug P for the outlet can be plugged through insertion holes 66 and 67, described later, into the corresponding first and second plugholes 46 and 47, i.e., for a total of three plugholes. In addition, the first plug-in terminals P1 of the plug P for the outlet are tabular terminals that are respectively connected to the positive pole and the negative pole of the power source. The second plug-in terminal P2 is a rod-shaped terminal that is connected to the ground (earth).

As illustrated in FIG. 8, an arc-shaped pivoting angle restriction groove 48 is formed in the front-side portion of the protrusion portion 41. The pivoting angle restriction groove 48 defines a cut shape determining the range for a predetermined angle. The pivoting angle restriction groove 48 engages with a pivoting angle restriction protrusion 68 (refer to FIG. 6), described later, of the rotor/cover 6. Additionally, both end faces of the pivoting angle restriction groove 48, along the circumference, are formed as stop faces 48*a* for stopping the pivoting angle restriction protrusion 68. A configuration is employed in which the pivoting angle of the rotor/cover 6, specifically the angle between a position where the pivoting angle restriction protrusion 68 abuts one stop face 48*a* and another position where the pivoting angle restriction protrusion 68 abuts the other stop face 48*a*, is restricted to a predetermined angle, e.g., about 90°. In addition, the groove wall face 48*b* of the pivoting angle restriction groove 48 is formed as an arc face having a predetermined radius. The bottom surface of the pivoting angle restriction groove 48 is formed as a plane whose height is the same as that of the bottom surface of the rotor-containing recess 40.

In addition, as illustrated in FIG. 6, a predetermined number of approximately semispherical small protrusions 49 (e.g., four; only two protrusions are illustrated in FIG. 6) protrude evenly spaced apart (e.g., 90°) from one another around the circumference of the peripheral portion of the bottom surface of the rotor-containing recess 40. The bottom face of a ring-shaped flange 69, described later, of the rotor/cover 6 is slidable on top of the small protrusions 49 along the circumference.

As illustrated in FIG. 6, the rotor/cover 6, for example, is molded synthetic resin and has a discoidal cover-plate portion 60 that is pivotably fitted to the rotor-containing recess 40 of the outlet cover 4. In addition, the rotor/cover 6 includes a hollow, cylindrical supporting axle portion 64 that protrudes from the lower side of the cover-plate portion 60 along the coaxial line L.

Insertion holes 66 and 67 are provided in the cover-plate portion 60 into which the respective plug-in terminals P1 and P2 of the plug P for the outlet can be inserted. In addition, at a usage position (described later) the insertion holes 66 and 67 correspond to the respective plugholes 46 and 47 of the outlet cover 4 (refer to FIG. 2).

Figure 3:
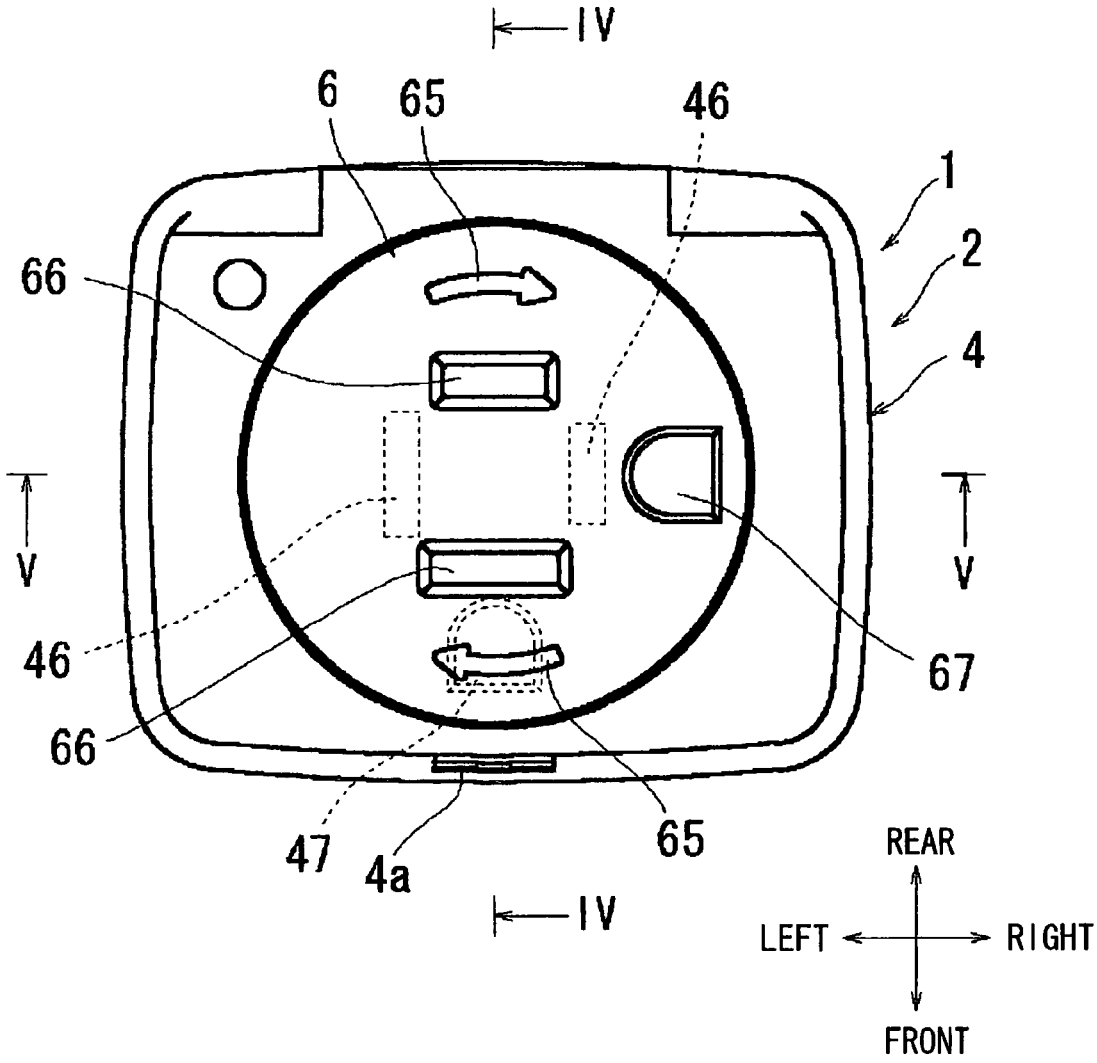
FIG. 3 is a plan view illustrating an outlet when the cover is removed and the rotor/cover is in a non-usage position.

Further, arrows 65 are formed on the upper side of the cover-plate portion 60 to indicate the direction (clockwise direction) for pivoting the cover-plate portion 60 in order to switch the position of the cover-plate portion 60 from a non-usage position to the usage position (refer to FIG. 3).

As illustrated in FIG. 6, a circular protrusion portion 61 is formed on the lower side of the cover-plate portion 60. The circular protrusion portion 61 has a small thickness and is coaxial with the rotor-containing recess 40 with respect to the line L. The protrusion portion 61 is formed in such a way as to have a diameter approximately equal to the radius of the groove wall face 48*b* (refer to FIG. 8) of the pivoting angle restriction groove 48 of the outlet cover 4.

A spring-containing recess 62 is formed in the protrusion portion 61 that is upper-and-lower symmetric with the spring-containing recess 42 of the outlet cover 4, which has the spring-bearing plane 42*a* and two of the engagement portions 43. In addition, in the spring-containing recess 62 of the rotor/cover 6, the numeral "4" in the tens position of the reference numerals for each of the portions that correspond to respective portions of the spring-containing recess 42 of the outlet cover 4 are replaced by the numeral "6" for the rotor/cover 6. The explanations for the similar portions of the spring-containing recess 62 will be omitted (refer to FIG. 9). Additionally, the two engagement portions 63 (refer to FIG. 9) are formed in such a way as to be shifted in phase by 90° with respect to the two engagement portions 43 (refer to FIG. 8) of the outlet cover 4.

Figure 5:
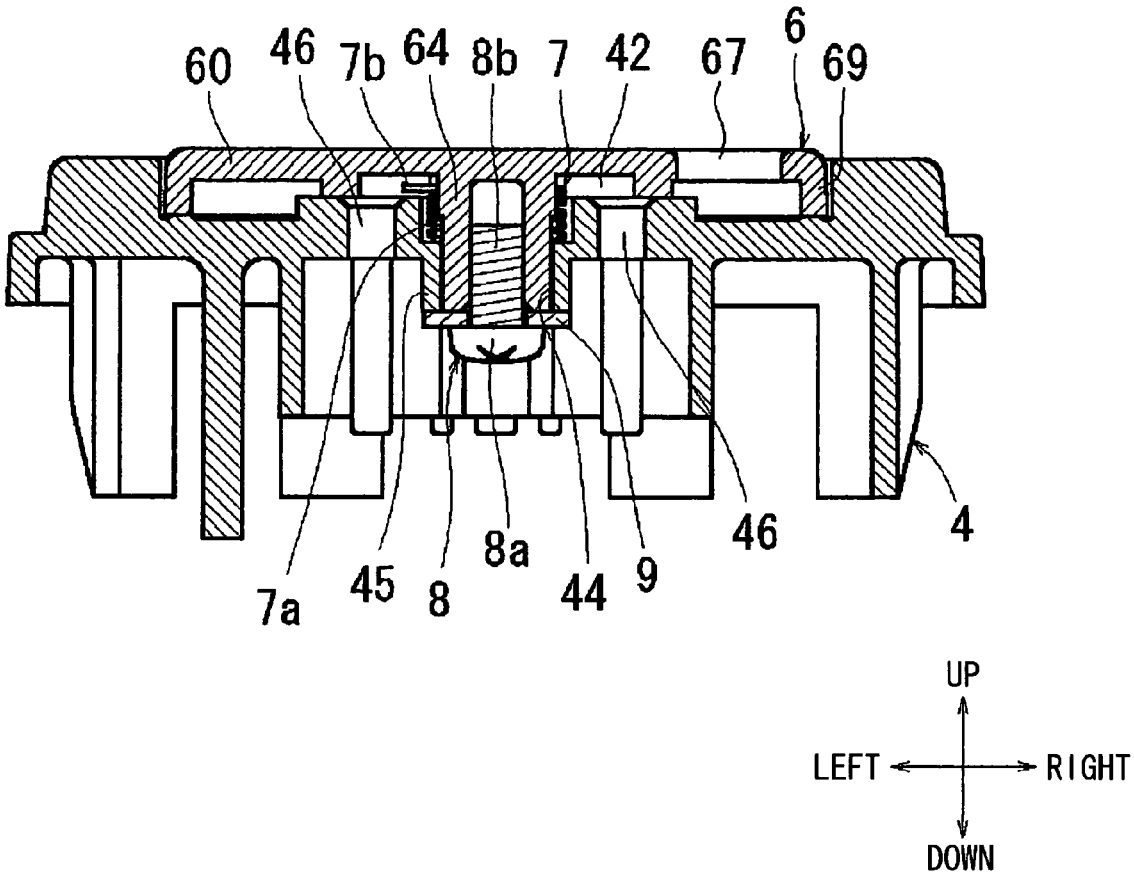
FIG. 5 is a cross-sectional view of the outlet in FIG. 3, taken along the line indicated by the arrows V-V.

As illustrated in FIG. 6, a cylindrical supporting axle portion 64 protrudes from the spring-bearing plane 62*a* of the spring-containing recess 62. The cylindrical supporting axle portion 64 is coaxial with the cover-plate portion 60. As illustrated in FIGS. 4 and 5, a configuration is employed in which the supporting axle portion 64 is pivotally inserted into and supported by the axle hole 44 of the outlet cover 4. Additionally, a configuration is employed in which the front face (lower face) of the supporting axle portion 64 is approximately on the same plane as that on which the lower face of the tubular portion 45 of the outlet cover 4 is situated when the lower face of the ring-shaped flange 69, described later, of the cover-plate portion 60 is slidably abutting the small protrusions 49 of the outlet cover 4.

As illustrated in FIG. 6, the pivoting angle restriction protrusion 68 protrudes from the lower side of the cover-plate portion 60, outside of the circumference of the protrusion portion 61. A configuration is employed in which the pivoting angle restriction protrusion 68 is movable in the pivoting angle restriction groove 48 within the predetermined pivoting angle (90°) of the rotor/cover 6. The pivoting angle restriction protrusion 68 is prevented from moving beyond the positions where the pivoting angle restriction protrusion 68 abuts the stop faces 48*a* of the pivoting angle restriction groove 48 (refer to FIG. 8).

Additionally, the ring-shaped flange 69 that protrudes downward is formed around the circumference of the cover-plate portion 60 (refer to FIG. 6). A configuration is employed in which the lower face of the ring-shaped flange 69 is slidably supported abutting the small protrusions 49 of the outlet cover 4.

As illustrated in FIG. 6, the torsion spring 7 includes a spiraling clockwise in an upward direction (sinistrorse) coil portion 7*a* whose number of turns is the sum of a predetermined number of turns and an additional three-quarter turn. In addition, the torsion spring 7 includes respective torsional arms 7*b* that protrude radially outward from both ends of the coil portion 7*a*. A configuration is employed in which the supporting axle portion 64 of the rotor/cover 6 is relatively inserted into the hollow of the coil portion 7*a*, thereby supporting the coil portion 7*a* (refer to FIGS. 4 and 5). In addition, a configuration is employed in which the lower section of the coil portion 7*a* is positioned by being fitted to both of the left and right wall faces 42*b* of the spring-containing recess 42 of the outlet cover 4 and to the positioning faces 43*a* of both of the engagement portions 43 (refer to FIG. 10). Similarly, a configuration is employed in which the upper section of the coil portion 7*a* is positioned by being fitted to both of the left and right wall faces 62*b* of the spring-containing recess 62 of the outlet cover 6 and to the positioning faces 63*a* of both of the engagement portions 63. In addition, the respective terminal portion 7*b* can abut a corresponding engagement face 43*b* of the engagement portions 43 of the outlet cover 4 or a corresponding engagement face 63*b* of the engagement portions 63 of the rotor/cover 6 (refer to FIG. 10).

As illustrated in FIG. 7, the screw 8 is in the form of, e.g., a stainless-steel pan-head tapping screw. The screw 8 has a head portion 8*a* having a cross-shaped hole for example (e.g., Phillips style) and a self-tapping screw shaft portion 8*b*. The self-tapping screw shaft portion 8*b* can be threaded into the hollow portion of the supporting axle portion 64 of the rotor/cover 6.

In addition, the washer 9 is made of, for example, a resin having high degree of self-lubricity, such as a polyacetal. The washer 9 is formed as a ring-shaped plate having a hollow hole 9*a* to which the self-tapping screw shaft portion 8*b* of the screw 8 can be fitted. A configuration is employed in which the washer 9 is interposed between the tubular portion 45 of the outlet cover 4 and the head portion 8*a* of the screw 8. The washer 9 enables the rotor/cover 6, including the screw 8, to smoothly pivot with respect to the outlet cover 4 (refer to FIGS. 4 and 5).

Next, an example of a procedure for mounting the foregoing constituent components will be explained.

Initially, the torsion spring 7 is fitted to the spring-containing recess 42 of the outlet cover 4. In this situation, the coil portion 7*a* of the torsion spring 7 is positioned at a predetermined position, i.e., in such a way as to be approximately coaxial with the axle hole 44. The coil portion 7*a* is fitted between both of the left and right wall faces 42*b* of the spring-containing recess 42 and between the positioning faces 43*a* of the two engagement portions 43 (refer to FIG. 10).

Figure 18:
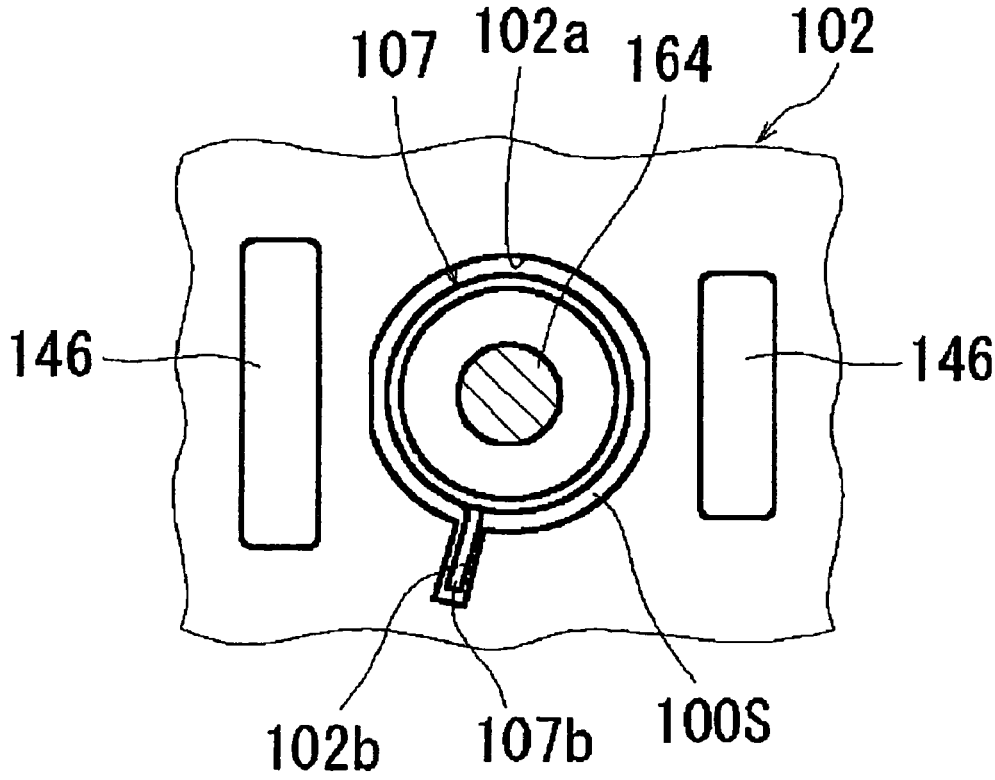
Fig.18 PRIOR ART
FIG. 18 is an explanatory view illustrating the relationship among an outlet main body, a torsion spring, and a pivotal axle, according to a conventional technique.

In addition, the lower terminal portion 7*b* of the torsion spring 7 can be situated at an arbitrary orientation, as long as the lower terminal portion 7*b* abuts the spring-bearing plane 42*a* of the spring-containing recess 42 of the outlet cover 4. In other words, as long as the lower terminal portion 7*b* can abut the spring-bearing plane 42*a* in the vicinity of one of the front and rear wall faces 42*c* (refer to FIG. 8) of the spring-containing recess 42 (refer to the double-dashed lines 7*b* in FIG. 10), the torsion spring 7 is properly oriented. Accordingly, it is not necessary to take the trouble to implement the positioning of a terminal portion 107*b* and fit it to a groove portion 102*b*, as in a conventional technique (refer to FIG. 18). This also applies to the case in which the torsion spring 7 is disposed upside down or inverted.

Additionally, in this situation the top section of the torsion spring 7, including the upper terminal portion 7*b*, protrudes upward beyond the protrusion portion 41 of the outlet cover 4 (refer to FIGS. 4 and 5).

The supporting axle portion 64 of the rotor/cover 6 is then inserted into both the coil portion 7*a* of the torsion spring 7 and the axle hole 44 of the outlet cover 4. In this situation, for example, when the lower terminal portion 7*b* of the torsion spring 7 is situated in the front of the spring-bearing plane 42*a* of the outlet cover 4, the second plughole 67 of the rotor/cover 6 is caused to correspond to the orientation of the upper terminal portion 7*b*. In contrast, when the lower terminal portion 7*b* of the torsion spring 7 is situated in the rear of the spring-bearing plane 42*a* of the outlet cover 4, the first plughole 66 of the rotor/cover 6 is caused to correspond to the counter-orientation of the upper terminal portion 7*b*. In this situation, when the supporting axle portion 64 of the rotor/cover 6 is inserted into the axle hole 44 of the outlet cover 4, the pivoting angle restriction protrusion 68 of the rotor/cover 6 abuts the protrusion portion 41 of the outlet cover 4. Consequently, the cover-plate portion 60 of the rotor/cover 6 can only be half fitted to the rotor-containing recess 40 of the outlet cover 4.

Thereafter, the rotor/cover 6 is pivoted clockwise. Then, corresponding to the spring-bearing plane 62*a* of the spring-containing recess 62 of the rotor/cover 6, the upper terminal portion 7*b* of the torsion spring 7 is fitted to the spring-containing recess 62. This is the same as the case in which the lower terminal portion 7*b* of the torsion spring 7 is made to abut the spring-bearing plane 42*a* of the spring-containing recess 42 of the outlet cover 4.

Subsequently, an engagement face 43*b* of the engagement portion 43, which is situated closer to the upper terminal portion 7*b* of the torsion spring 7 when the rotor/cover 6 pivots anti-clockwise, abuts the upper terminal portion 7*b*.

Then, reacting to the rotor/cover 6, the torsion spring 7 is pivoted. As a result, the lower terminal portion 7*b* of the torsion spring 7 abuts the engagement face 43*b* of the engagement portion 43 that is situated closer to the lower terminal portion 7*b* of the torsion spring 7 when the rotor/cover 6 pivots clockwise (refer to FIG. 10). This is the same for the case in which the upper terminal portion 7*b* of the torsion spring 7 abuts the engagement face 63*b* of the engagement portion 63 of the rotor/cover 6.

Furthermore, pivoting of the rotor/cover 6 elastically deforms the torsion spring 7 in such a way as to reduce the coil diameter. Then, at the same time that the pivoting angle restriction protrusion 68 of the rotor/cover 6 fits into the pivoting angle restriction groove 48 of the outlet cover 4, the cover-plate portion 60 of the rotor/cover 6 positively fits into the rotor-containing recess 40 of the outlet cover 4. In this situation, the coil portion 7*a* of the torsion spring 7 is positioned at a predetermined position, i.e., in such a way as to be approximately coaxial with the supporting axle portion 64. The coil portion 7*a* is positioned through both the left and right wall faces 62*b* of the spring-containing recess 62 and the positioning faces 63*a* of the two engagement portions 63. In addition, the ring-shaped flange 69 of the rotor/cover 6 slidably abuts the small protrusions 49 in the rotor-containing recess 40 of the outlet cover 4. Additionally, the bottom face of the supporting axle portion 64 of the rotor/cover 6 is situated at approximately the same plane as that of the bottom face of the tubular portion 45 of the outlet cover 4.

Next, the screw 8 is threaded into the supporting axle portion 64 of the rotor/cover 6 from the lower side of the outlet cover 4. More particularly, with the tapping-screw shaft portion 8*b* of the screw 8 passing through the washer 9 via the hole 9*a*, the screw 8 is threaded into the hollow cylindrical hole of the supporting axle portion 64 of the rotor/cover 6.

As a result, the washer 9 is fastened to the supporting axle portion 64 of the rotor/cover 6 and slidably abuts, or is adjacent to, the tubular portion 45 of the outlet cover 4. Accordingly, the rotor/cover 6 is prevented from being detached from the outlet cover 4 (refer to FIGS. 4 and 5).

In this situation, the rotor/cover 6 is urged anti-clockwise through the elastic restoring force of the torsion spring 7. As a result, the pivoting angle restriction protrusion 68 of the rotor/cover 6 abuts the right-hand stop face 48*a* of the pivoting angle restriction groove 48 in the outlet cover 4. Accordingly, the rotor/cover 6 is retained at a "non-usage position". In this situation, as illustrated in FIG. 3, all of the plugholes 46 and 47 of the outlet cover 4 are closed off or covered by the rotor/cover 6. Accordingly, the entry of foreign materials through the plugholes 46 and 47 and into the outlet main body 2 can be prevented or reduced.

When the outlet 1 is utilized, the rotor/cover 6 is pivoted clockwise, i.e., in a direction indicated by the arrows 65 marked on the rotor/cover 6, through further elastic deformation of the torsion spring 7. The pivoting angle restriction protrusion 68 of the rotor/cover 6 then abuts the left-hand stop face 48*a* of the pivoting angle restriction groove 48 in the outlet cover 4. At this point, the rotor/cover 6 is at a "usage position" (refer to FIG. 2). In this situation, the insertion holes 66 and 67 of the rotor/cover 6 correspond to the respective plugholes 46 and 47 of the outlet cover 4. As a result, all of the plugholes 46 and 47 are opened.

When the rotor/cover 6 is at the "usage position", the plug-in terminals P1 and P2 of the plug P (refer to FIG. 2) for the outlet can be inserted through the insertion holes 66 and 67 of the rotor/cover 6 and into the respective plugholes 46 and 47 of the outlet cover 4. In other words, the outlet plug P can be connected with the outlet 1. In addition, while the plug P for the outlet is connected with the outlet 1, the plug P prevents the rotor/cover 6 from being pivoted to the "non-usage position" (anti-clockwise), otherwise occurring through the elastic restoring force of the torsion spring 7.

Additionally, when the plug P for the outlet is disconnected from the outlet 1, the elastic restoring force of the torsion spring 7 pivots the rotor/cover 6 anti-clockwise to reposition the rotor/cover 6 in the "non-usage position" (refer to FIG. 3).

With the outlet 1 described as above, the supporting axle portion 64, provided between the outlet main body 2 (particularly, the outlet cover 4) and the rotor/cover 6, can prevent or reduce the wobbling of the coil portion 7*a* of the torsion spring 7. In particular, during the pivoting of the rotor/cover 6 to a "usage position", the space S decreases between the inner surface of the torsion spring 7 and the outer surface of the supporting axle portion 64 when the torsion spring 7 is elastically deformed in such a way so as to reduce the coil diameter. Therefore, the wobbling of the coil portion 7*a* of the torsion spring 7 can be effectively suppressed. The foregoing fact is advantageous for the enhancement of the stability of the rotor/cover 6.

Moreover, by utilizing the relative pivoting of the rotor/cover 6 with respect to the outlet cover 4, the torsional arms 7*b* of the torsion spring 7 are respectively engaged with the outlet cover 4 and the rotor/cover 6. Therefore, the torsion spring 7 can be readily mounted.

Further, by utilizing the relative pivoting of the rotor/cover 6 with respect to the outlet cover 4, the torsional arms 7*b* of the torsion spring 7 respectively abut an engagement portion 43 of the outlet cover 4 and an engagement portion 63 of the rotor/cover 6 in the circumferential direction. Accordingly, the mounting positions of the torsional arms 7*b* of the torsion spring 7 with regard to the outlet cover 4 and the rotor/cover 6 are not limited to specifically fixed positions. The range in which the torsional arms 7*b* can be mounted is enlarged. As a result, the torsional arms 7*b* of the torsion spring 7 can be readily mounted.

Figure 9:
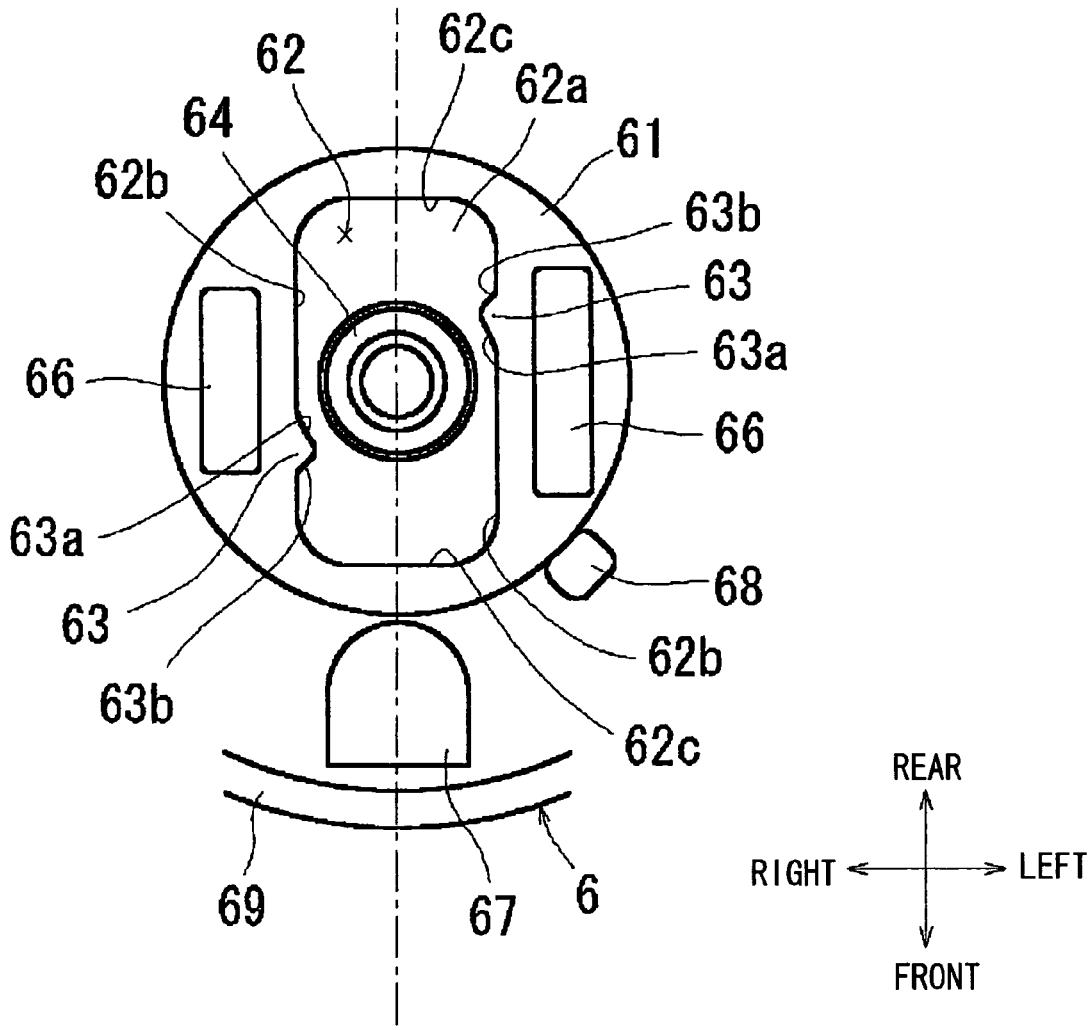
FIG. 9 is a bottom view illustrating the central parts of a rotor/cover.

Furthermore, in the engagement portions 43 of the outlet cover 4 and the engagement portions 63 of the rotor/cover 6, positioning faces 43*a* and 63*a* are respectively formed that can position the coil portions 7*a* of the torsion spring 7 (refer to FIGS. 8 and 9). Accordingly, the engagement portions 43 of the outlet cover 4 and the engagement portions 63 of the rotor/cover 6 can also be utilized to position the torsion spring 7.

Moreover, the torsion spring 7 can be contained in the spring-containing recesses 42 and 62 respectively provided in the outlet cover 4 and the rotor/cover 6 (refer to FIGS. 4 and 5). Still further, an effect can also be demonstrated in which the setting of the torsion spring 7 in the outlet cover 4 is facilitated, a member having no supporting axle portion 64, because a spring-containing recess 42 is provided in the outlet cover 4.

Embodiment 2

Embodiment 2 of the present invention will be explained next. Because Embodiment 2 is obtained by partially modifying Embodiment 1 described above, duplicate descriptions of common components may be omitted. Similarly, in the Embodiments following Embodiment 2, duplicate descriptions of common components may also be omitted.

Figure 11:
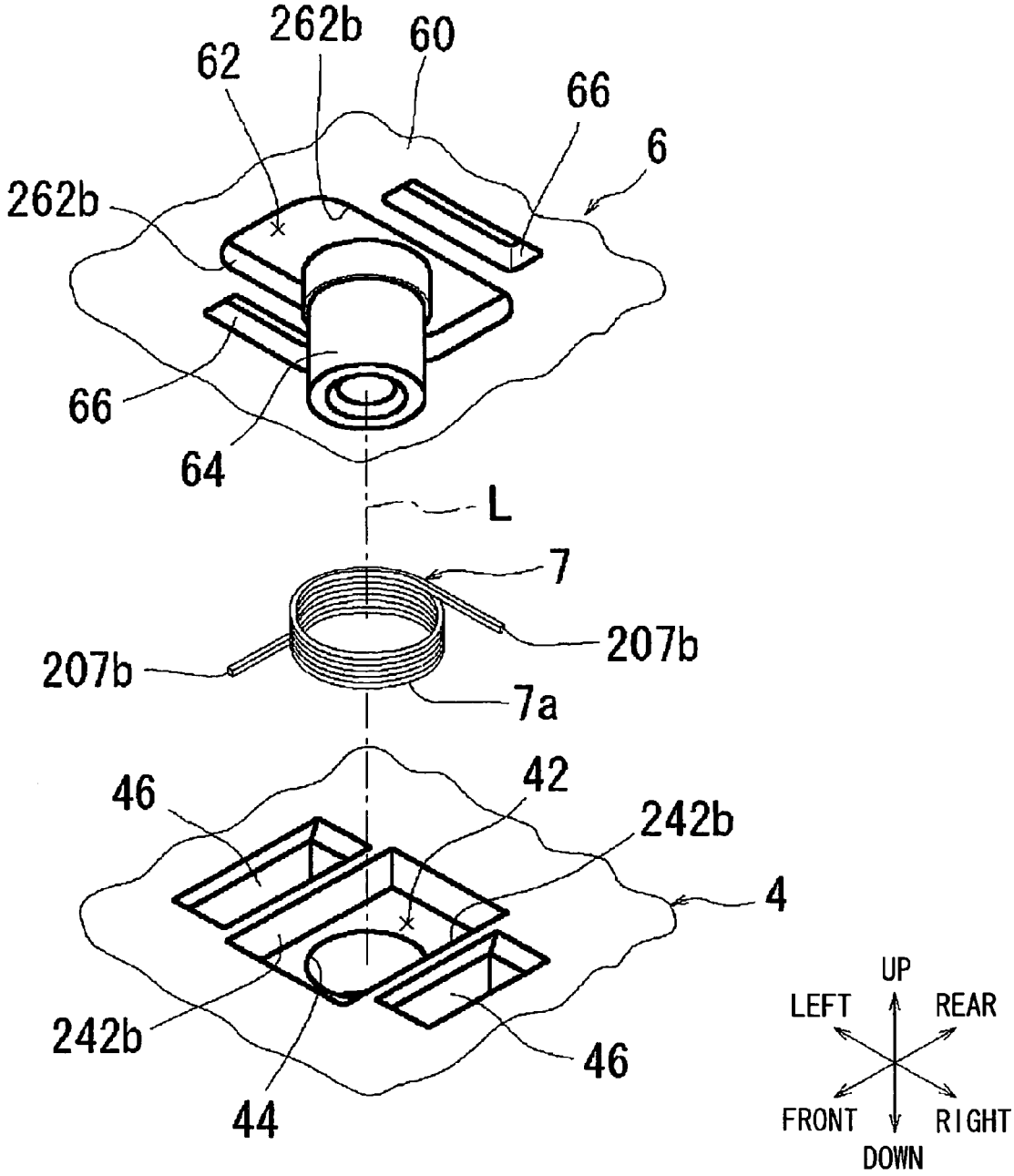
FIG. 11 is an exploded perspective view illustrating the relationship among an outlet main body, a rotor/cover, and a torsion spring according to Embodiment 2 of the present invention.

In Embodiment 2, as illustrated in FIG. 11 with regard to the spring-containing recess 42 of the outlet cover 4 and the spring-containing recess 62 of the rotor/cover 6, respective engagement portions 43 and 63 are omitted. Both of the left and right wall faces (respectively designated by reference characters 242*b* and 262*b*) of the respective spring-containing recesses 42 and 62 are formed as flat wall faces. Therefore, both of the respective sets of wall faces 242*b* and 262*b* can function as engagement portions.

In addition, respective torsional arms (designated by reference character 207*b*) of the torsion spring 7 protrude in directions tangential to the coil portion 7*a*. The torsional arms 207*b* can respectively abut the wall faces 242*b* and 262*b* in a line contact fashion.

Embodiment 3

Embodiment 3 of the present invention will now be explained. Embodiment 3 is obtained by partially modifying Embodiment 2 (refer to FIG. 11) described above.

Figure 12:
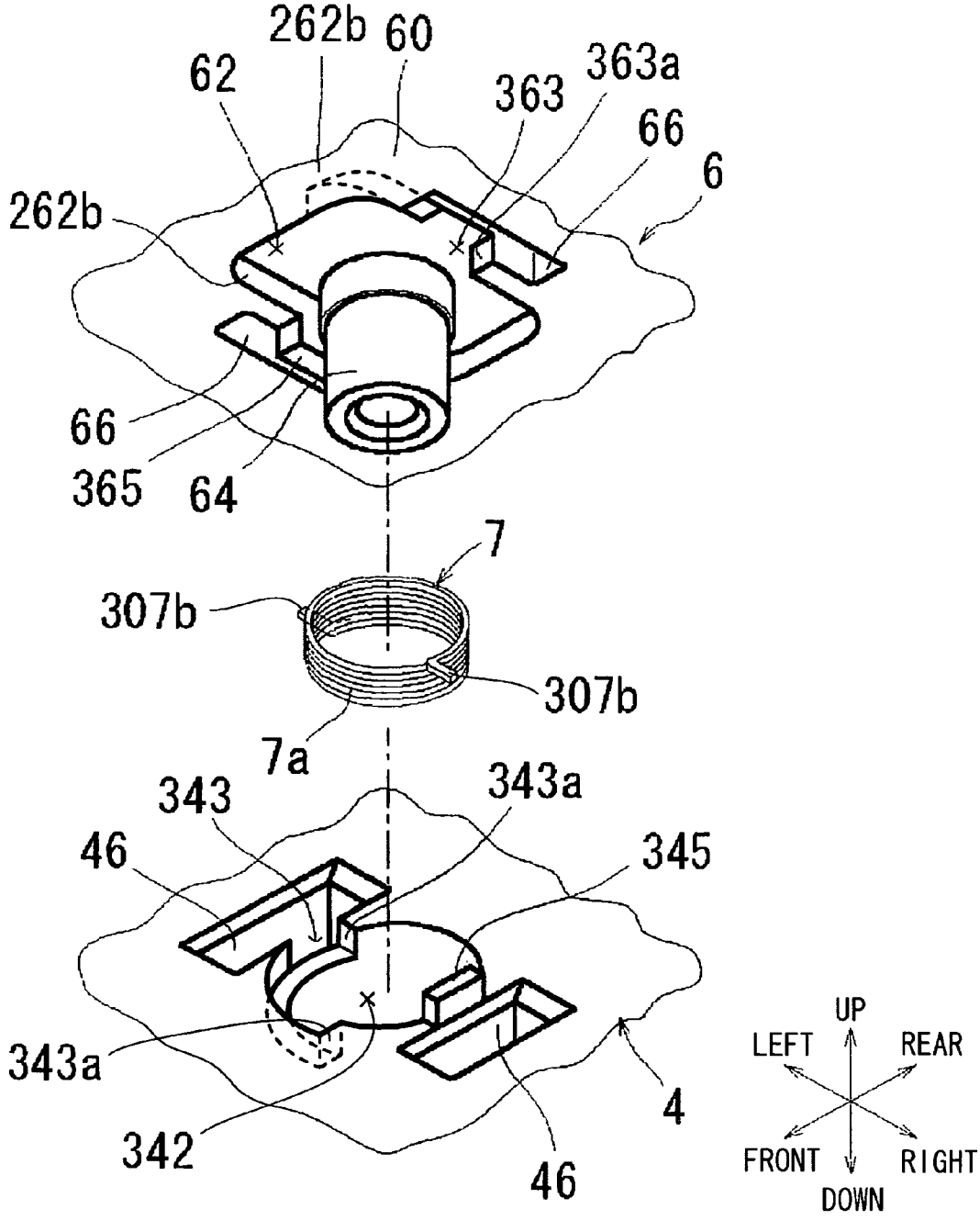
FIG. 12 is an exploded perspective view illustrating the relationship among an outlet main body, a rotor/cover, and a torsion spring according to Embodiment 3 of the present invention.

In Embodiment 3, as illustrated in FIG. 12, a spring-containing recess (designated by reference numeral 342) of the outlet cover 4 is formed as a circular recess that can contain the coil portion 7*a* of the torsion spring 7. In the outlet cover 4, a positioning groove 343 is formed that connects the spring-containing recess 342 and one of the first plugholes 46 (on the left-hand side as viewed in FIG. 12). Moreover, a positioning protrusion 345 is formed at a position on the upper side of the outlet cover 4. The positioning protrusion is between the spring-containing recess 342 of the outlet cover 4 and the other one of the first plugholes 46 (on the right-hand side as viewed in FIG. 12).

The respective torsional arms (designated by reference character 307*b*) of the torsion spring 7 protrude in radial directions from the coil portion 7*a*.

Furthermore, from a position on the lower side of the rotor/cover 6 a positioning protrusion 365 protrudes between the spring-containing recess 62 of the rotor/cover 6 and the one (on the left-hand side in FIG. 12) of the first insertion holes 66 (on the left-hand side in FIG. 12). The positioning protrusion 365 fits into the positioning groove 343 of the outlet cover 4. In the rotor/cover 6 a positioning groove 363 is formed that connects the spring-containing recess 62 and the other one of the first insertion holes 66 (on the right-hand side in FIG. 12). The positioning groove 363 accommodates the positioning protrusion 345 of the outlet cover 4.

In Embodiment 3, both groove-wall faces 343*a* of the positioning groove 343 of the outlet cover 4, and the groove-wall face 363*a* of the positioning groove 363 of the rotor/cover 6, can function as respective engagement portions for the torsional arms 307*b* of the torsion spring 7.

Accordingly with Embodiment 3, through the fitting between the positioning groove 343 of the outlet cover 4 and the positioning protrusion 365 of the rotor/cover 6, and the fitting between the positioning protrusion 345 of the outlet cover 4 and the positioning groove 363 of the rotor/cover 6, the workability can be raised in the positioning of the rotor/cover 6 with respect to the outlet cover 4.

Furthermore, due to the positioning protrusion 345 of the outlet cover 4 and the positioning protrusion 365 of the rotor/cover 6, the occurrence of a spark can be effectively prevented or reduced in a case where the plug P for the outlet is connected to the outlet 1.

Embodiment 4

Next, Embodiment 4 of the present invention will be explained. Embodiment 4 is obtained by partially modifying Embodiment 2 (refer to FIG. 11) described above.

Figure 13:
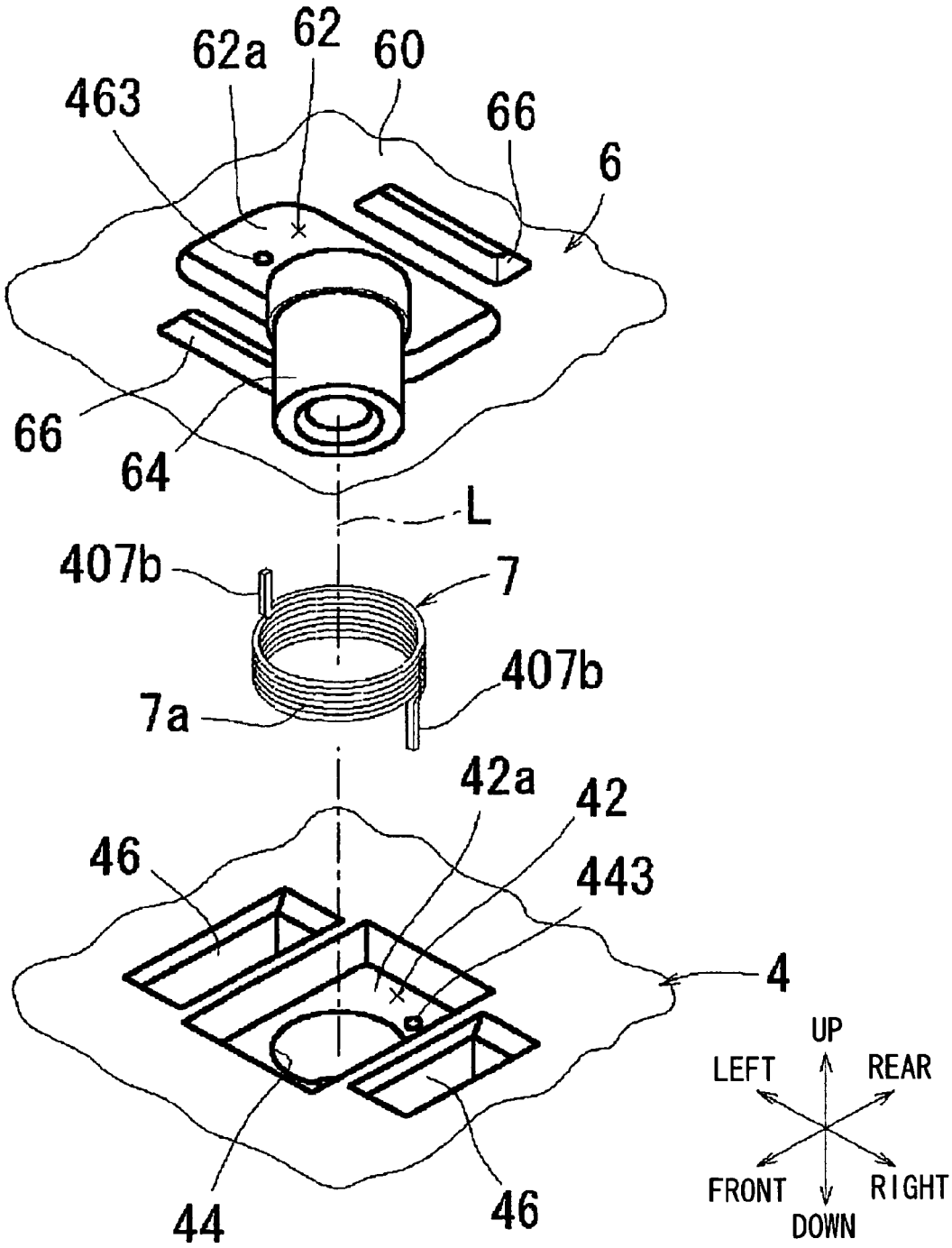
FIG. 13 is an exploded perspective view illustrating the relationship among an outlet main body, a rotor/cover, and a torsion spring according to Embodiment 4 of the present invention.

As illustrated in FIG. 13, in Embodiment 4 the respective torsional arms (designated by reference character 407*b*) of the torsion spring 7 protrude in opposite directions from the coil portion 7*a*. The torsional arms 407*a* protrude parallel to the axis line L.

Engagement holes 443 and 463 are respectively provided in the spring-bearing plane 42*a* of the spring-containing recess 42 of the outlet cover 4 and the spring-bearing plane 62*a* of the spring-containing recess 62 of the rotor/cover 6. By utilizing the relative pivoting of the rotor/cover 6 with respect to the outlet main body 2, the engagement holes 443 and 463 can be fitted with the corresponding torsional arms 407*b* of the torsion spring 7.

Embodiment 5

Embodiment 5 of the present invention will now be explained. Embodiment 5 is obtained by partially modifying Embodiment 4 (refer to FIG. 13) described above.

Figure 14:
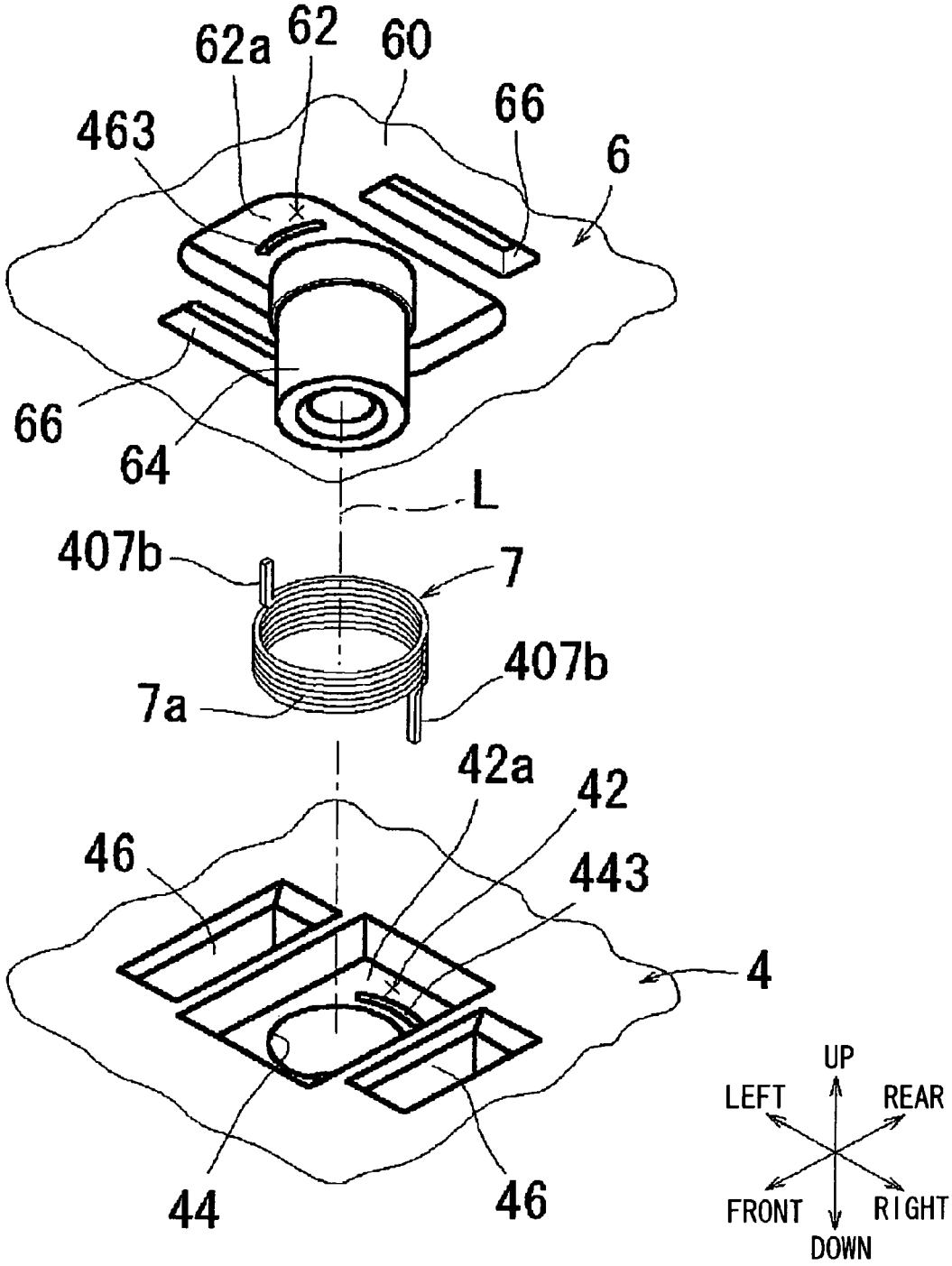
FIG. 14 is an exploded perspective view illustrating the relationship among an outlet main body, a rotor/cover, and a torsion spring according to Embodiment 5 of the present invention.

As illustrated in FIG. 14, in Embodiment 5 the engagement hole 443 of the outlet main body 2 and the engagement hole 463 of the rotor/cover 6 are formed as arc-shaped slots that extend about the axis line L. Consequently, the torsional arms 407*b* of the torsion spring 7 can be more readily fitted to the respective engagement holes 443 and 463 through the relative pivoting of the rotor/cover 6 with respect to the outlet main body 2.

Embodiment 6

Embodiment 6 of the present invention will be explained next. Embodiment 6 is obtained by partially modifying Embodiment 1 (refer to FIGS. 1 to 10) described above.

Figure 15:
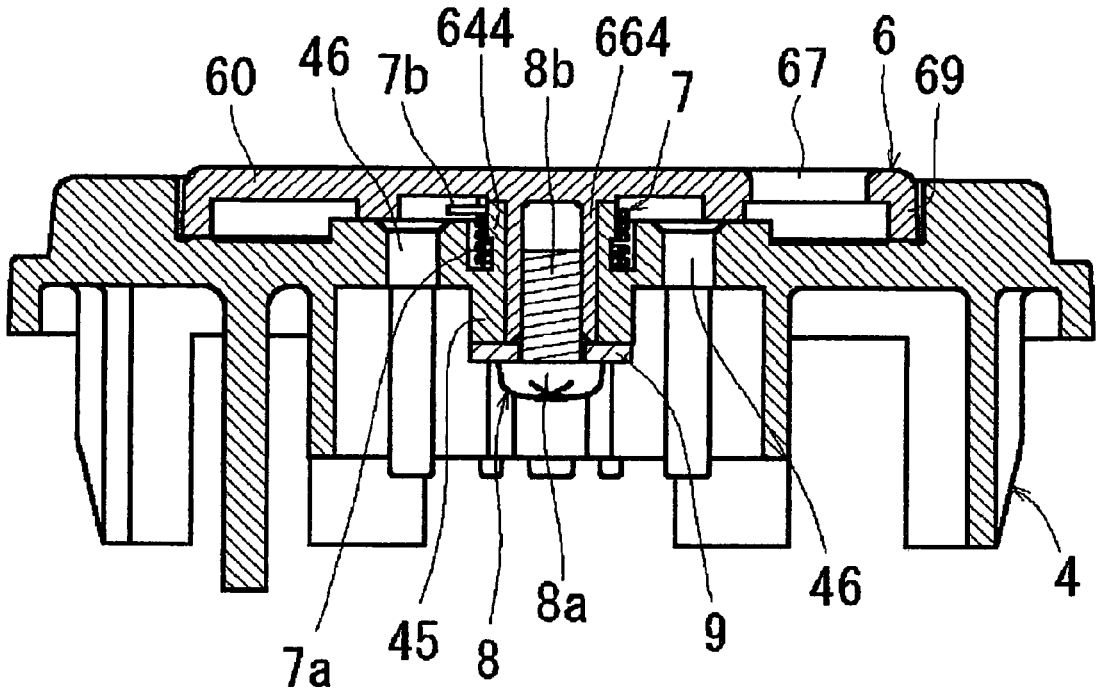
FIG. 15 is across-sectional view illustrating an outlet according to Embodiment 6 of the present invention.

In Embodiment 6, as illustrated in FIG. 15, a supporting axle portion (designated by reference numeral 644) is formed in the outlet cover 4. The supporting axle portion 644 can support the coil portion 7*a* of the torsion spring 7. In addition, in the rotor/cover 6 the supporting axle portion 64 of Embodiment 1 (refer to FIG. 5) is formed as a rotating-axle portion (designated by reference numeral 664) that can be inserted into the supporting axle portion 644 of the outlet cover 4. As is the case with Embodiment 1, the screw 8 is threaded into the lower end portion of the rotating-axle portion 664.

Embodiment 7

Next, Embodiment 7 of the present invention will be explained. Embodiment 7 is obtained by partially modifying Embodiment 1 described above.

Figure 16:
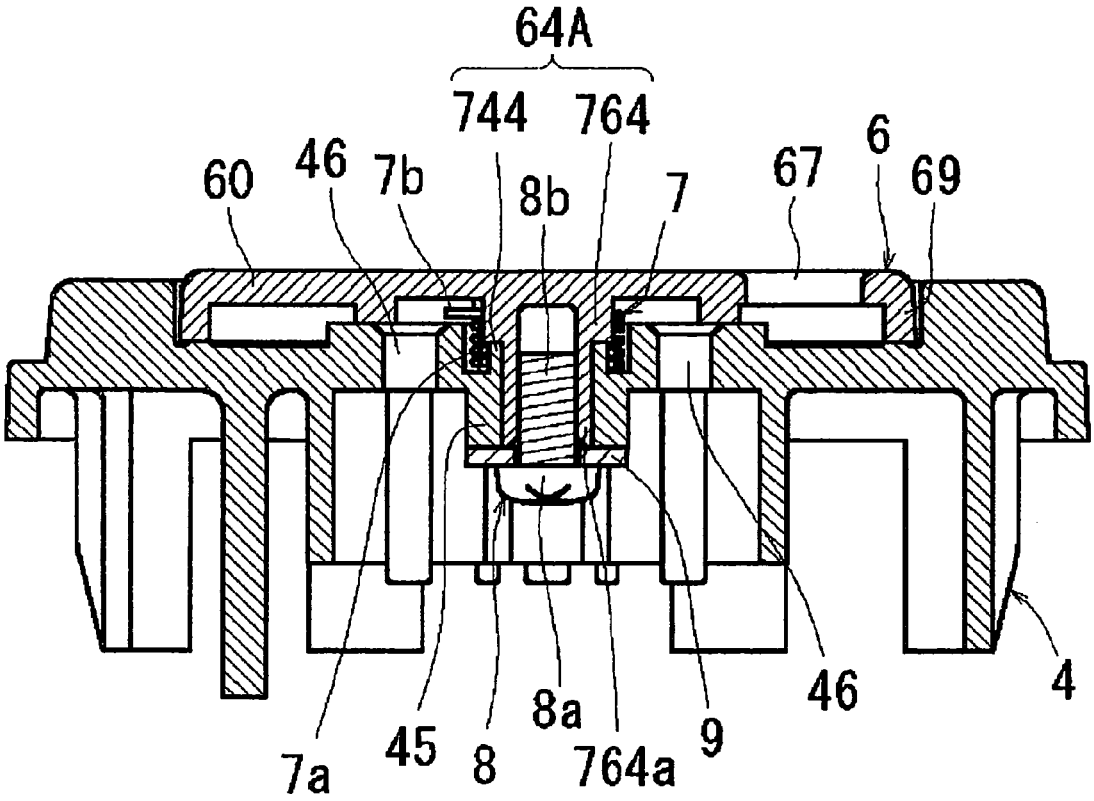
FIG. 16 is across-sectional view illustrating an outlet according to Embodiment 7 of the present invention.
Figure 17:
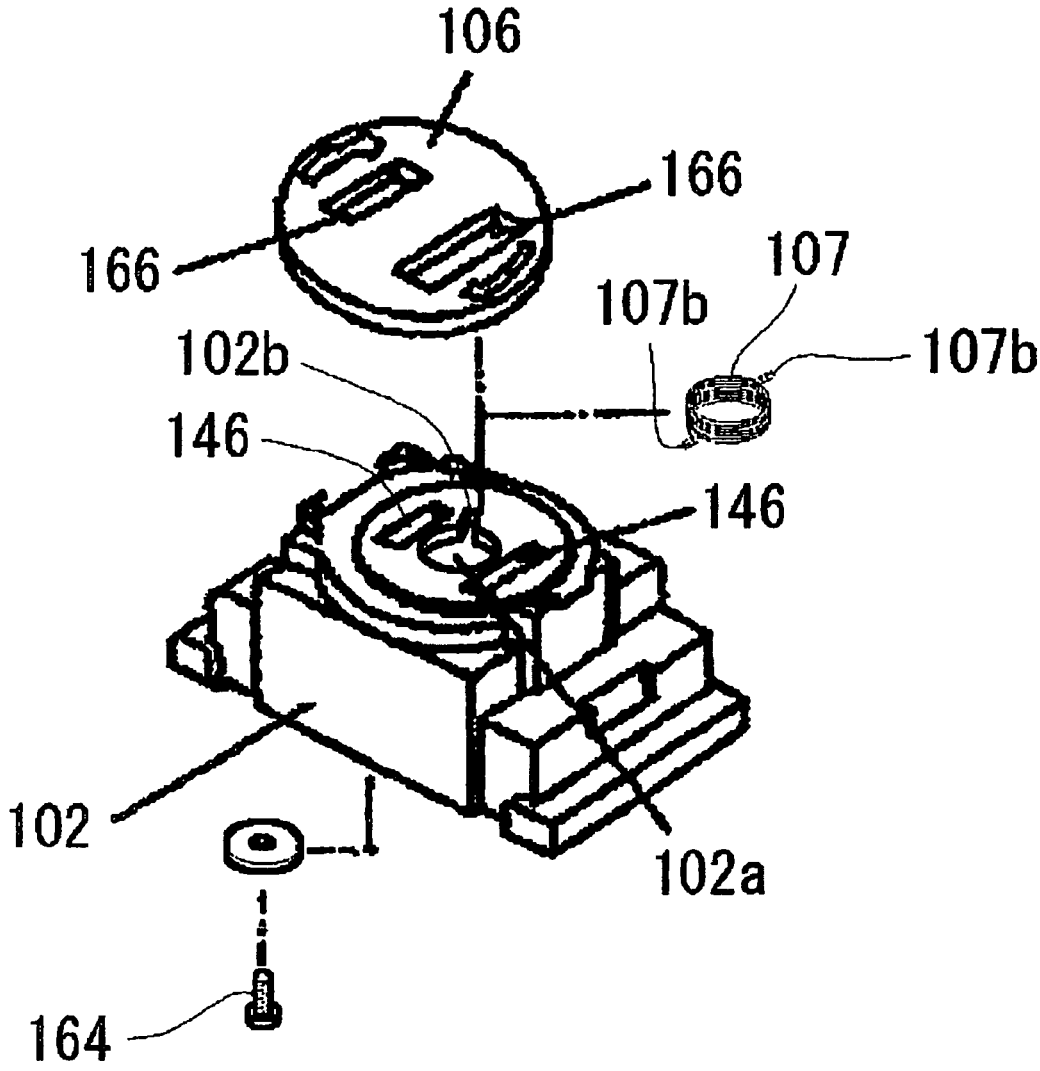
Fig.17 PRIOR ART
FIG. 17 is an exploded perspective view illustrating an outlet according to a conventional technique.

As illustrated in FIG. 16, in Embodiment 7 a supporting axle portion (designated by reference numeral 744) is formed in the outlet cover 4. The supporting axle portion 744 can support the lower half of the coil portion 7*a* of the torsion spring 7. In addition, another supporting axle portion (designated by reference numeral 764) is formed in the rotor/cover 6. The other supporting axle portion 764 can support the upper half of the coil portion 7*a* of the torsion spring 7. In other words, the supporting axle portion 744 of the outlet cover 4 and the supporting axle portion 764 of the rotor/cover 6 form a single continuous supporting axle portion (designated by reference character 64A). Additionally, a rotating-axle portion 764*a* coaxially protrudes from the supporting axle portion 764. The rotating-axle portion 764*a* can be inserted into the supporting axle portion 744 of the outlet cover 4. As is the case with Embodiment 1, the screw 8 is threaded to the lower end portion of the rotating-axle portion 764*a*.

It is to be understood that the present invention is not limited to the foregoing embodiments. Modifications to the foregoing embodiments may be implemented without departing from the spirit and scope of the present invention. For example, an outlet 1 according to the present invention is not limited for use in vehicles, and instead the outlet 1 can be widely used in households, factories, buildings, and the like. Moreover, either one of the spring-containing recess 42 of the outlet cover 4 and the spring-containing recess 62 of the rotor/cover 6 can be omitted. In addition, the number of respective engagement portions 43 and 63 in the spring-containing recesses 42 and 62 can appropriately be increased or decreased. Furthermore, the engagement portions 43 and 63 can be formed as protrusions that respectively protrude from simple and flat spring-bearing planes 42*a* and 62*a*. Additionally, the positioning faces 43*a* and 63*a*, respectively provided in the engagement portions 43 and 63, can be prepared separately from the engagement portions 43 and 63.

What is claimed is:

1. An outlet comprising:

an outlet main body having plugholes for engaging plug-in terminals of a plug;

a rotor/cover having insertion holes through which the plug-in terminals can be inserted;

wherein the rotor/cover is pivotal with respect to the outlet main body between a non-usage position in which the plugholes are covered by the rotor/cover and a usage-position in which the insertion holes are aligned with the corresponding plugholes;

a torsion spring that is interposed between the outlet main body and the rotor/cover and urges the rotor/cover to the non-usage position;

wherein the torsion spring is a twisted coil spring comprising a coil portion and torsional arms extending out from axial ends of the coil portion; and a supporting axle portion provided between the outlet main body and the rotor/cover that is located inside of the coil portion of the torsion spring;

wherein the outlet main body and the rotor/cover have engagement portions for engagement with the torsional arms of the torsion spring;

wherein pivoting of the rotor/cover with respect to the outlet main body engages each of the torsional arms of the torsion spring with a corresponding one of the engagement portions of the outlet main body and the rotor/cover in a circumferential direction;

wherein each of the torsional arms extends in a plane perpendicular to a central axis of the torsion spring; and wherein each of the engagement portions further comprises a first engagement slope for contacting with a terminal portion of the twisted coil spring; and a second engagement slope for abutting the circumference of the coil portion of the twisted coil spring;

wherein the engagement portion of the outlet main body is located 90° out of phase from the engagement portion of the rotor cover when the rotor/cover is assembled to the outlet main body and in a non-usage position.

2. The outlet according to claim 1, wherein the outlet main body further comprises an outlet spring-containing recess containing at least part of one end of the twisted coil spring;

the rotor/cover further comprises a rotor/cover spring-containing recess containing at least part of an other end of the twisted coil spring;

wherein the engagement portion of the outlet main body is located in the outlet spring-containing recess; and wherein the engagement portion of the rotor/cover is located in the rotor/cover spring-containing recess.

3. The outlet according to claim 2, wherein the outlet main body comprises two said engagement portions; and wherein the rotor/cover comprises two said engagement portions.

4. An outlet comprising:

an outlet main body having plugholes for engaging plug-in terminals of a plum;

a rotor/cover having insertion holes through which the plug-in terminals can be inserted;

wherein the rotor/cover is pivotal with respect to the outlet main body between a non-usage position in which the plugholes are covered by the rotor/cover and a usage-position in which the insertion holes are aligned with the corresponding plugholes;

a torsion spring that is interposed between the outlet main body and the rotor/cover and urges the rotor/cover to the non-usage position;

wherein the torsion spring is a twisted coil spring comprising a coil portion and torsional arms extending out from axial ends of the coil portion; and a supporting axle portion provided between the outlet main body and the rotor/cover that is located inside of the coil portion of the torsion spring;

wherein the outlet main body and the rotor/cover have engagement portions for engagement with the torsional arms of the torsion spring;

wherein pivoting of the rotor/cover with respect to the outlet main body engages each of the torsional arms of the torsion spring with a corresponding one of the engagement portions of the outlet main body and the rotor/cover in a circumferential direction;

wherein each of the torsional arms extends in a plane perpendicular to a central axis of the torsion spring;

wherein the outlet main body further comprises an outlet spring-containing recess containing at least a portion of one end of the twisted coil spring;

wherein the engagement portion of the outlet main body is at least one wall of the outlet spring-containing recess;

wherein the rotor/cover further comprises a rotor/cover spring-containing recess containing at least a portion of an other end of the twisted coil spring; and wherein the engagement portion of the rotor/cover is at least one wall of the rotor/cover spring-containing recess.

5. The outlet according to claim 4, wherein each of the torsional arms extends in a tangential direction to the circumference of the twisted coil spring.

6. An outlet comprising:

an outlet main body having plugholes for engaging plug-in terminals of a plug;

a rotor/cover having insertion holes through which the plug-in terminals can be inserted;

wherein the rotor/cover is pivotal with respect to the outlet main body between a non-usage position in which the plugholes are covered by the rotor/cover and a usage-position in which the insertion holes are aligned with the corresponding plugholes;

a torsion spring that is interposed between the outlet main body and the rotor/cover and urges the rotor/cover to the non-usage position;

wherein the torsion spring is a twisted coil spring comprising a coil portion and torsional arms extending out from axial ends of the coil portion; and a supporting axle portion provided between the outlet main body and the rotor/cover that is located inside of the coil portion of the torsion spring;

wherein the outlet main body and the rotor/cover have engagement portions for engagement with the torsional arms of the torsion spring;

wherein pivoting of the rotor/cover with respect to the outlet main body engages each of the torsional arms of the torsion spring with a corresponding one of the engagement portions of the outlet main body and the rotor/cover in a circumferential direction;

wherein each of the torsional arms extends in a plane perpendicular to a central axis of the torsion spring;

wherein each of the engagement portions further comprises a first engagement slope for contacting with a terminal portion of the twisted coil spring; and a second engagement slope for abutting the circumference of the coil portion of the twisted coil spring; and wherein the engagement portion of the outlet main body is located out of phase from an engagement portion of the rotor cover when the rotor/cover is assembled to the outlet main body and in a non-usage position.

7. An outlet comprising:

an outlet main body comprising:

at least one plughole for engaging a corresponding number of plug-in terminals of a plug;

an outlet engagement surface;

a rotor/cover recess configured to accommodate a rotor/cover, wherein the rotor/cover recess further comprises a plurality of recess protrusions evenly spaced within and around a circumference of the rotor/cover recess;

a rotor/cover having insertion holes corresponding to each of the at least one plughole through which the plug-in terminals can be inserted, said rotor/cover comprising a rotor/cover engagement surface, wherein the rotor/cover is pivotal between a non-usage position and a usage-position with respect to the outlet main body and wherein a surface of the rotor/cover corresponding to a location of the plurality of recess protrusions slidingly contacts the plurality of recess protrusions;

a torsion spring that is interposed between the outlet main body and the rotor/cover and urges the rotor/cover to the non-usage position, wherein the torsion spring comprises two torsional arms each extending in a corresponding plane perpendicular to a central axis of the torsion spring, one of the two torsional arms contacts the outlet engagement surface and an other one of the two torsional arms contacts the rotor/cover engagement surface;

wherein a supporting axle portion is provided between the outlet main body and the rotor/cover and is fitted to and supports the inside of a coil portion of the torsion spring; and wherein pivoting the rotor/cover with respect to the outlet main body engages the two torsional arms of the torsion spring with the corresponding outlet engagement surface and the rotor/cover engagement surface.

8. The outlet as in claim 7, further comprising:

an outlet spring-containing recess containing one end portion of the torsion spring wherein the one end portion of the torsion spring is defined along the central axis of the torsion spring;

an outlet spring-bearing plane abutting the one end portion of the torsion spring;

a rotor/cover spring-containing recess containing an other end portion of the torsion spring, wherein the other end portion of the torsion spring is defined along the central axis of the torsion spring;

a rotor spring-bearing plane abutting the other end portion of the torsion spring;

wherein the outlet engagement surface is located in the outlet spring-containing recess; and wherein the rotor/cover engagement surface is located in the rotor/cover spring-containing recess.

9. The outlet as in claim 8, wherein:

the outlet engaging surface is perpendicular to the outlet spring-bearing plane; and the rotor/cover engaging surface is perpendicular to the rotor/cover spring-bearing plane.

10. The outlet as in claim 9, wherein:

the outlet engaging surface is one face along a circumferential direction about the central axis of the torsion spring of a first groove formed in a wall of the outlet spring-containing recess; and the rotor/cover engaging surface is one face along a circumferential direction about the central axis of the torsion spring of a second groove formed in a wall of the rotor/cover spring-containing recess.

11. The outlet as in claim 9, wherein:

the outlet engaging surface is a substantially triangular protrusion extending from the outlet spring-bearing plane in a direction toward the rotor/cover;

the rotor/cover engaging surface is a substantially triangular protrusion extending from the rotor/cover spring-bearing plane in a direction toward the outlet main body;

wherein a first surface of the outlet engaging surface abuts the circumference of the torsion spring;

wherein a second surface of the outlet engaging surface abuts the one of the two torsional arms;

wherein a first surface of the rotor/cover engaging surface abuts the circumference of the torsion spring; and wherein a second surface of the rotor/cover engaging surface abuts the other of the two torsional arms.

12. The outlet as in claim 7 wherein the outlet main body comprises three plug holes.

13. An outlet comprising:

an outlet main body having plugholes for engaging plug-in terminals of a plug;

a rotor/cover having insertion holes through which the plug-in terminals can be inserted;

wherein the rotor/cover is pivotal with respect to the outlet main body between a non-usage position in which the plugholes are covered by the rotor/cover and a usage-position in which the insertion holes are aligned with the corresponding plugholes;

a torsion spring that is interposed between the outlet main body and the rotor/cover and urges the rotor/cover to the non-usage position;

a supporting axle portion provided between the outlet main body and the rotor/cover that is located inside of a coil portion of the torsion spring; and wherein pivoting of the rotor/cover with respect to the outlet main body engages torsional arms of the torsion spring with the outlet main body and the rotor/cover;

wherein each of the torsional arms extends in a plane perpendicular to a central axis of the torsion spring and engages with a corresponding engagement portion of the outlet main body and the rotor/cover in a circumferential direction;

wherein each of the engagement portions further comprises:

a first engagement slope for contacting with a terminal portion of a twisted coil spring; and a second engagement slope for abutting the circumference of the coil portion of the twisted coil spring; and wherein the engagement portion of the outlet main body is located 90° out of phase from an engagement portion of the rotor cover when the rotor/cover is assembled to the outlet main body and in a non-usage position.

14. The outlet according to claim 13, wherein the outlet main body further comprises an outlet spring-containing recess containing at least part of one end of the twisted coil spring;

the rotor/cover further comprises a rotor/cover spring-containing recess containing at least part of an other end of the twisted coil spring;

wherein the engagement portion of the outlet main body is located in the outlet spring-containing recess; and wherein the engagement portion of the rotor/cover is located in the rotor/cover spring-containing recess.

15. The outlet according to claim 14, wherein the outlet main body comprises two engagement portions; and wherein the rotor/cover comprises two engagement portions.

16. An outlet comprising:

an outlet main body having plugholes for engaging plug-in terminals of a plug;

a rotor/cover, having insertion holes through which the plug-in terminals can be inserted;

wherein the rotor/cover is pivotal with respect to the outlet main body between a non-usage position in which the plugholes are covered by the rotor/cover and a usage-position in which the insertion holes are aligned with the corresponding plugholes;

a torsion spring that is interposed between the outlet main body and the rotor/cover and urges the rotor/cover to the non-usage position;

a supporting axle portion provided between the outlet main body and the rotor/cover that is located inside of a coil portion of the twisted coil spring; and wherein pivoting of the rotor/cover with respect to the outlet main body engages torsional arms of the torsion spring with the outlet main body and the rotor/cover;

wherein each of the torsional arms extends in a plane perpendicular to a central axis of the torsion spring and engages with a corresponding engagement portion of the outlet main body and the rotor/cover in a circumferential direction;

wherein the outlet main body further comprises an outlet spring-containing recess containing at least a portion of one end of a twisted coil spring;

wherein the engagement portion of the outlet main body is at least one wall of the spring-containing recess;

wherein the rotor/cover further comprises a rotor/cover spring-containing recess containing at least a portion of an other end of the twisted coil spring; and wherein the engagement portion of the rotor/cover is at least one wall of the rotor/cover spring-containing recess.

17. An outlet comprising:

an outlet main body comprising:

at least one plughole for engaging a corresponding number of plug-in terminals of a plug;

an outlet engagement surface;

a rotor/cover recess configured to accommodate a rotor/cover, wherein the rotor/cover recess further comprises a plurality of recess protrusions spaced within and around a circumference of the rotor/cover recess; a rotor/cover having insertion holes corresponding to each of the at least one plughole through which the plug-in terminals can be inserted, the rotor/cover comprising a rotor/cover engagement surface, wherein the rotor/cover is pivotal between an non-usage position and a usage-position with respect to the outlet main body and a surface of the rotor/cover corresponding to a location of the plurality of recess protrusions slidingly contacts the plurality of recess protrusions; and a torsion spring that is interposed between the outlet main body and the rotor/cover and urges the rotor/cover to the non-usage position, wherein the torsion spring is a twisted coil spring comprising a coil portion and torsional arms extending out from axial ends of the coil portion, one of the two torsional arms contacts the outlet engagement surface and an other one of the two torsional arms contacts the rotor/cover engagement surface;

wherein a supporting axle portion is provided between the outlet main body and the rotor/cover that is fitted to and supports the inside of the coil portion of the torsion spring; and wherein pivoting the rotor/cover with respect to the outlet main body engages the two torsional arms of the torsion spring with the corresponding outlet engagement surface and the rotor/cover engagement surface.

* * * * *

UNITED STATES PATENT AND TRADEMARK OFFICE

CERTIFICATE OF CORRECTION

PATENT NO. : 7,331,804 B2
APPLICATION NO. : 11/354121
DATED : February 19, 2008
INVENTOR(S) : Hiroki Okada et al.

It is certified that error appears in the above-identified patent and that said Letters Patent is hereby corrected as shown below:

In column 14, line 59, “plum” should read --plug--.

Signed and Sealed this

Seventh Day of October, 2008

JON W. DUDAS
*Director of the United States Patent and Trademark Office*